US008771615B2

(12) United States Patent
Shibata et al.

(10) Patent No.: US 8,771,615 B2
(45) Date of Patent: Jul. 8, 2014

(54) COMPOUND CONTAINER AND POURING-OUT METHOD

(75) Inventors: Tomoyuki Shibata, Yokohama (JP); Natsuki Masuya, Yokohama (JP); Yoshiaki Seto, Otawara (JP); Shingo Saito, Tokyo (JP); Yasuyoshi Mori, Otawara (JP); Yutaka Kubota, Otawara (JP); Hidetoshi Kanda, Otawara (JP); Tsugunori Notomi, Otawara (JP); Teijirou Kanada, Yokohama (JP); Youichi Takano, Yokohama (JP); Yasuyuki Takeuchi, Yokohama (JP); Akira Onishi, Otawara (JP)

(73) Assignees: Toyo Seikan Kaisha, Ltd., Tokyo (JP); Eiken Kagaku Kabushiki Kaisha, Tokyo (JP)

( * ) Notice: Subject to any disclaimer, the term of this patent is extended or adjusted under 35 U.S.C. 154(b) by 129 days.

(21) Appl. No.: 12/736,337

(22) PCT Filed: Mar. 3, 2009

(86) PCT No.: PCT/JP2009/053965

§ 371 (c)(1),
(2), (4) Date: Nov. 8, 2010

(87) PCT Pub. No.: WO2009/130948

PCT Pub. Date: Oct. 29, 2009

(65) Prior Publication Data

US 2011/0052459 A1 Mar. 3, 2011

(30) Foreign Application Priority Data

Apr. 24, 2008 (JP) ..... 2008-113419

(51) Int. Cl.
*B01L 3/14* (2006.01)

(52) U.S. Cl.
USPC ..... 422/550; 422/512; 422/547; 422/554; 422/556; 436/180

(58) Field of Classification Search
USPC ..... 422/547, 549–550
See application file for complete search history.

(56) References Cited

U.S. PATENT DOCUMENTS 2,897,994 A 8/1959 Foss
4,898,293 A 2/1990 Morel (Continued)

FOREIGN PATENT DOCUMENTS

DE 3531071 A * 3/1987
DE 100 22 835 A1 11/2001

(Continued)

OTHER PUBLICATIONS

Machine translation of JP-2000313484-A.*

(Continued)

*Primary Examiner* — Jill Warden
*Assistant Examiner* — Dwayne K Handy
(74) *Attorney, Agent, or Firm* — Manabu Kanesaka

(57) ABSTRACT

A compound container has a container main body forming a first accommodation chamber, an auxiliary container forming a second accommodation chamber, a mounting part on which the auxiliary container is mounted in the container main body, a cutting part which cuts a second accommodation chamber partition wall which partitions a part of the second accommodation chamber formed in the auxiliary container, a contents outlet port in the container main body, and an opening pouring element mounted on the contents outlet port and having another cutting part which cuts a first accommodation chamber partition wall which partitions a part of the first accommodation chamber formed in the container main body.

19 Claims, 20 Drawing Sheets

(56) References Cited

U.S. PATENT DOCUMENTS

| | | | | |
|---|---|---|---|---|
| 5,178,838 | A * | 1/1993 | Sala et al. | 422/558 |
| 5,246,145 | A | 9/1993 | Leoncavallo et al. | |
| 5,425,920 | A * | 6/1995 | Conti et al. | 422/558 |
| 5,514,341 | A * | 5/1996 | Urata et al. | 422/534 |
| 5,782,345 | A | 7/1998 | Guasch et al. | |
| 5,916,525 | A * | 6/1999 | Husar et al. | 422/547 |
| 7,284,676 | B2 | 10/2007 | Dantani | |
| 2003/0024830 | A1 | 2/2003 | Sharon | |
| 2003/0052019 | A1 | 3/2003 | Song | |
| 2003/0132244 | A1 | 7/2003 | Birkmayer et al. | |
| 2005/0145242 | A1 | 7/2005 | Romeu | |
| 2006/0272963 | A1 | 12/2006 | Sharon | |
| 2007/0093765 | A1 * | 4/2007 | Kawashiro et al. | 604/295 |

FOREIGN PATENT DOCUMENTS

| | | | |
|---|---|---|---|
| EP | 1 481 921 | A1 | 12/2004 |
| FR | 2 142 762 | A1 | 2/1973 |
| JP | S63-152547 | | 6/1988 |
| JP | H07-112749 | A | 5/1995 |
| JP | 2000-85828 | A | 3/2000 |
| JP | 2000-152777 | | 6/2000 |
| JP | 2000-313484 | | 11/2000 |
| JP | 2000-313484 | A | 11/2000 |
| JP | 2002-225894 | A | 8/2002 |
| JP | 2002-0528352 | | 9/2002 |
| JP | 2005-231692 | A | 9/2005 |
| JP | 2006-306459 | | 11/2006 |
| JP | 2007-062768 | | 3/2007 |
| JP | 2008-026090 | | 2/2008 |
| WO | 2005/023665 | A1 | 3/2005 |

OTHER PUBLICATIONS

Virus vol. 54 No. 1, 2004 200, The Japanese Society for Virology.
Russian Patent Office, "Office Action for RU 2010147831/12 (069071)", Jan. 16, 2013.
Japan Patent Office, "Office Action for JP 2010-509108", Sep. 24, 2013.

* cited by examiner (b)

(a)

COMPOUND CONTAINER AND POURING-OUT METHOD

RELATED APPLICATIONS

The present application is National Phase of International Application No. PCT/JP2009/053965 filed Mar. 3, 2009, and claims priorities from Japanese Applications No. 2008-113419 filed Apr. 24, 2008, the disclosure of which is hereby incorporated by reference herein in its entirety.

TECHNICAL FIELD

The invention relates to a compound container capable of mixing the contents of a plurality of accommodation chamber formed in the container, while effectively avoiding the leakage of the contents to the outside environment. In particular, the invention relates to a compound container which can, when treating contents in a sealed container, effectively prevent the leakage of the contents to be heated to the outside environment during this treatment without causing the sealing performance of the container to be deteriorated, and the method for pouring a predetermined amount of a sample preparation liquid out of this compound container.

BACKGROUND ART

In genetic screening in the fields of medical treatments or medicines, several techniques of detecting the existence of pathogenic bacteria from the sample extracted from a subject's body are known. Of these techniques, a gene amplification method, known as the LAMP method has come to attract attention, which is capable of facilitating the detection in which the gene DNA of the extracted pathogenic bacteria and a predetermined reagent are mixed, and the resultant mixture is incubated at a predetermined temperature, thereby to amplify the target DNA (Non-Patent Document 1).

By such a gene amplification method, as compared with the conventional genetic screening, not only the inspection time is shortened, but also the presence of the target gene can be visually judged since a significantly large amount of amplified products are obtained, whereby simplification of the inspection has been attained.

Patent Document 1 discloses a sample extraction liquid container which prepares a sample extraction liquid to be dripped to a reaction reagent for detecting viruses, such as influenza virus.

Non-Patent Document 1: Virus, Volume 54, No. 1, pp. 107-112, 2004

Patent Document 1: JP-A-2008-26090

DISCLOSURE OF THE INVENTION

Problems to be Solved by the Invention

Meanwhile, in the above-mentioned gene amplification method, when the gene to be amplified is the one derived from pathogenic bacteria involving the risk of aerial infection, like tubercle bacillus, there were the following problems.

For example, during the process in which a sample containing tubercle bacillus and a predetermined reagent are mixed, and the resulting mixture is heated at a fixed temperature to extract a target gene, if this treatment is conducted in a container with its mouth being opened, the container may be toppled accidentally to cause the contents to be spilled over or to cause tubercle bacillus to be dispersed in the air from the opened mouth of the container. In such a case, a tester may be exposed to the risk of being infected with tubercle bacillus. That is, a tester's safety was not ensured.

On the other hand, in the sample extraction liquid container disclosed in Patent Document 1, it is possible to prepare a sample with the container being sealed, as well as to add the sample extraction liquid dropwise to the reaction reagent container, while filtering unnecessary ingredients, whereby the risk of contamination or infection when preparing a sample extraction liquid can be prevented.

However, in Patent Document 1, preparation of the sample liquid is completed only by immersing a sample collected from a patient in a solution, extracting, followed by filtering. The technique disclosed in Patent Document 1 does not take into consideration at all the case where the sample in the container is heated together with the container. Therefore, if the container in Patent Document 1 is applied to the above-mentioned gene amplification method as it is, the cylindrical container formed of a flexible material may be subjected to thermal deformation during the heat treatment, and the sealing performance thereof may be deteriorated. Therefore, a problem still exists that the contents are leaked to the outside environment.

The invention has been made in view of the above-mentioned circumstances. An object of the invention is to provide, when, for example, processing contents which are needed to be heat-treated by heating it together with the container or the like, while keeping the state where the contents are sealed within the container, a compound container which is capable of mixing the contents sealed in a plurality of accommodation chambers formed in the container while effectively avoiding the leakage of the contents to be heated to the outside environment, as well as a pouring method for pouring a predetermined amount of a sample preparation liquid from the compound container.

Means for Solving the Problems

The compound container according to the invention has a configuration in which the container at least comprises a container main body forming a first accommodation chamber and an auxiliary container forming a second accommodation chamber, wherein a mounting part on which the auxiliary container is mounted is provided in the container main body and a cutting part which cuts a second accommodation chamber partition wall which partitions part of the second accommodation chamber formed in the auxiliary container is formed, and when the auxiliary container is mounted on the container main body, the second accommodation chamber partition wall is cut, whereby the first accommodation chamber and the second accommodation chamber are intercommunicated.

The compound container according to the invention has a configuration, in order to enable the contents to be taken out from the first accommodation chamber, in which the contents outlet port is provided in the container main body and an opening pouring element to be mounted on the contents outlet port is provided, the opening pouring element is provided with a cutting part which cuts a first accommodation chamber partition wall which partitions part of the first accommodation chamber formed in the container main body, and when the opening pouring element is installed on the container main body, the first accommodation chamber partition wall is cut.

A pouring method according to the invention is a method in which, when pouring out from the pouring port a sample preparation liquid obtained by preparing a sample which has been collected from a subject by using the above-mentioned compound container and dripping the sample preparation liquid to a predetermined dropping container, a positioning means is provided for positioning the front end of the pouring port so that the distance between the front end of the pouring port and the inner bottom surface of the dripping container becomes constant when the pouring mouth is inserted into the dropping container, and on the dropping container, a liquid level line indicating at least the lower limit of the predetermined amount is displayed and, after positioning the front end of the pouring port while inserting the pouring port into the dropping container, the container main body is squeezed to allow the sample preparation liquid to be poured until the amount of the liquid which has been poured exceeds the liquid level line showing the lower limit, and while keeping the positioned state, the container main body is restored to suck the sample preparation liquid which has been excessively poured when the liquid level of the sample preparation liquid which has been poured exceeds the front end of the pouring port thus positioned, thereby allowing an adequate amount of a sample preparation liquid to be poured.

Advantageous Effects of the Invention

According to the compound container of the invention, the final extraction of the contents is conducted on the container main body side, and hence the auxiliary container can be designed only by noting the sealing performance thereof. For this reason, it is easy to allow the auxiliary container to have a structure which is surely sealed so that the contents may not be leaked outside, and the sealing performance thereof may not be impaired when the auxiliary container is subjected to any treatments separately from the container main body. As a result, the contents sealed within the accommodation chamber formed in each of the container main bodies and the auxiliary container can be mixed while keeping the state where they are isolated from the outside environment.

BEST MODE FOR CARRYING OUT THE INVENTION

The preferable embodiment of the invention will be described with reference to the drawings.

First Embodiment

The first embodiment of the invention will be explained.

Figure 1:
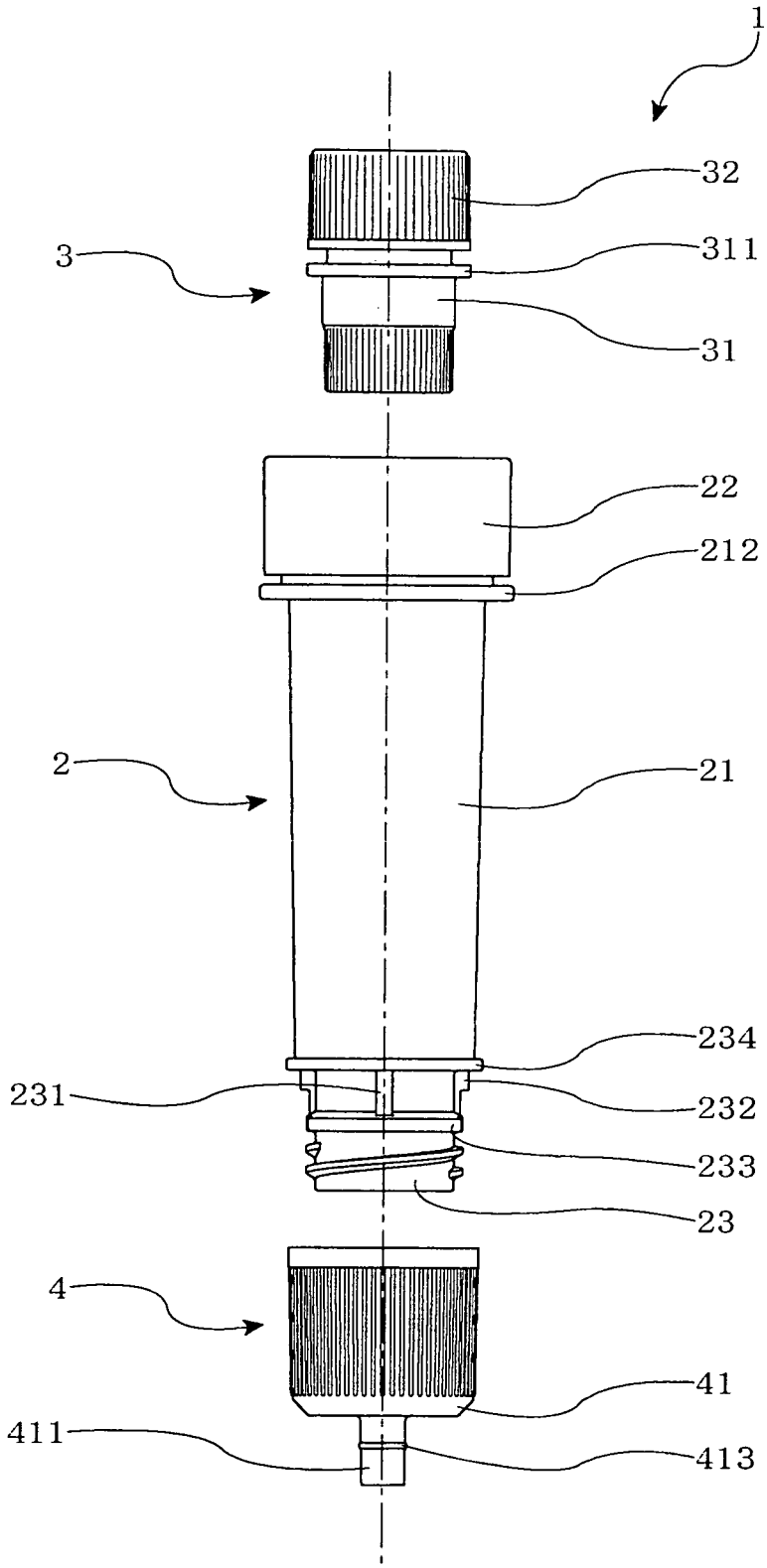
FIG. 1 is a schematic exploded view showing the first embodiment of the compound container according to the invention.
Figure 2:
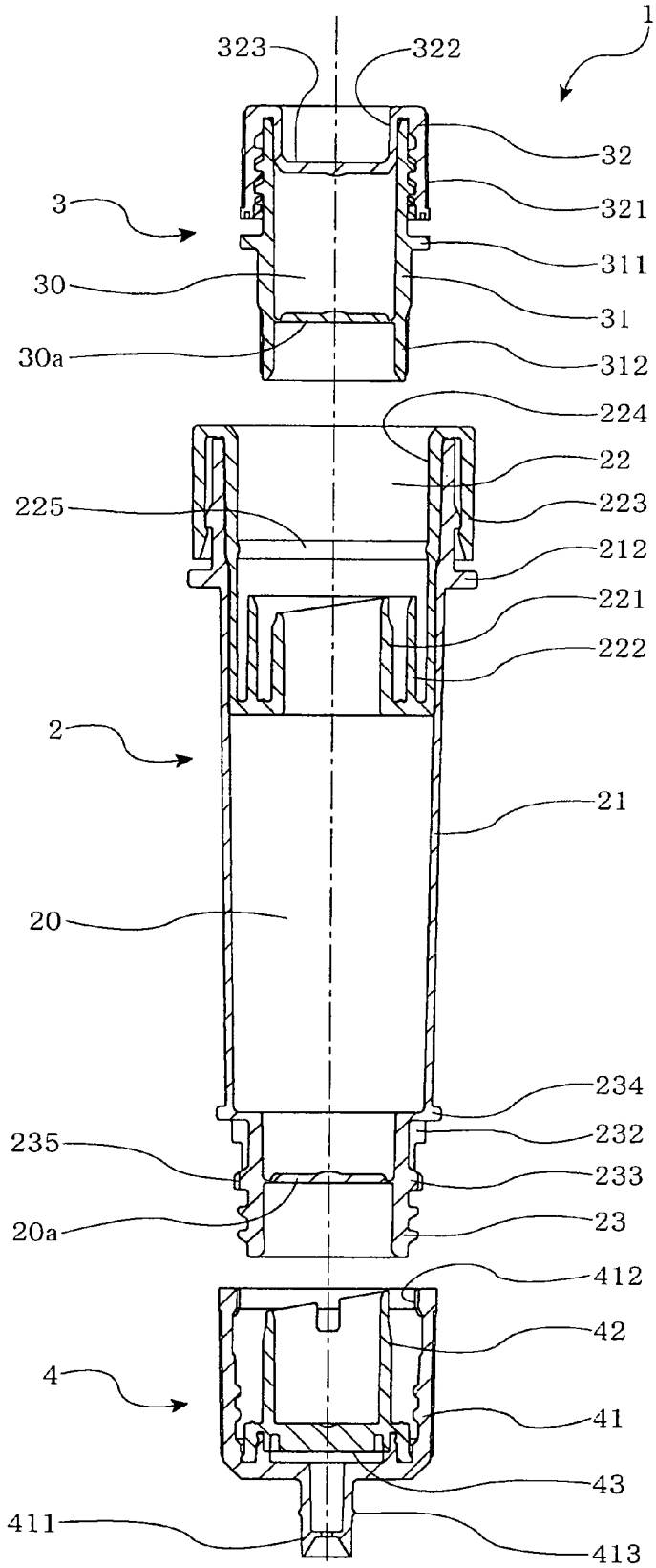
FIG. 2 is an exploded cross-sectional view showing the first embodiment of the compound container according to the invention.

FIG. 1 is an exploded view showing the outline of one example of the compound container according to this embodiment. FIG. 2 is a cross-sectional view obtained by cutting by a plane which is in parallel with the paper including the central axis indicated by a dashed line in FIG. 1.

First, the outline of the compound container according to this embodiment will be explained. In the example shown in FIG. 1 and FIG. 2, the compound container 1 is comprised of the container main body 2 which forms the first accommodation chamber 20, the auxiliary container 3 forming the second accommodation chamber 30, and the opening pouring element 4.

Moreover, when using the compound container 1, the auxiliary container 3 is mounted on the mounting part 22 of the container main body 2, and the opening pouring element 4 is mounted on the contents outlet port 23 of the container main body 2. At the time of distribution and storage before use, as shown in FIG. 3, a sealing element 5 is attached to the mounting part 22 of the container main body 2, and a protecting element 6 is attached to the contents outlet port 23 of the container main body 2.

Figure 3:
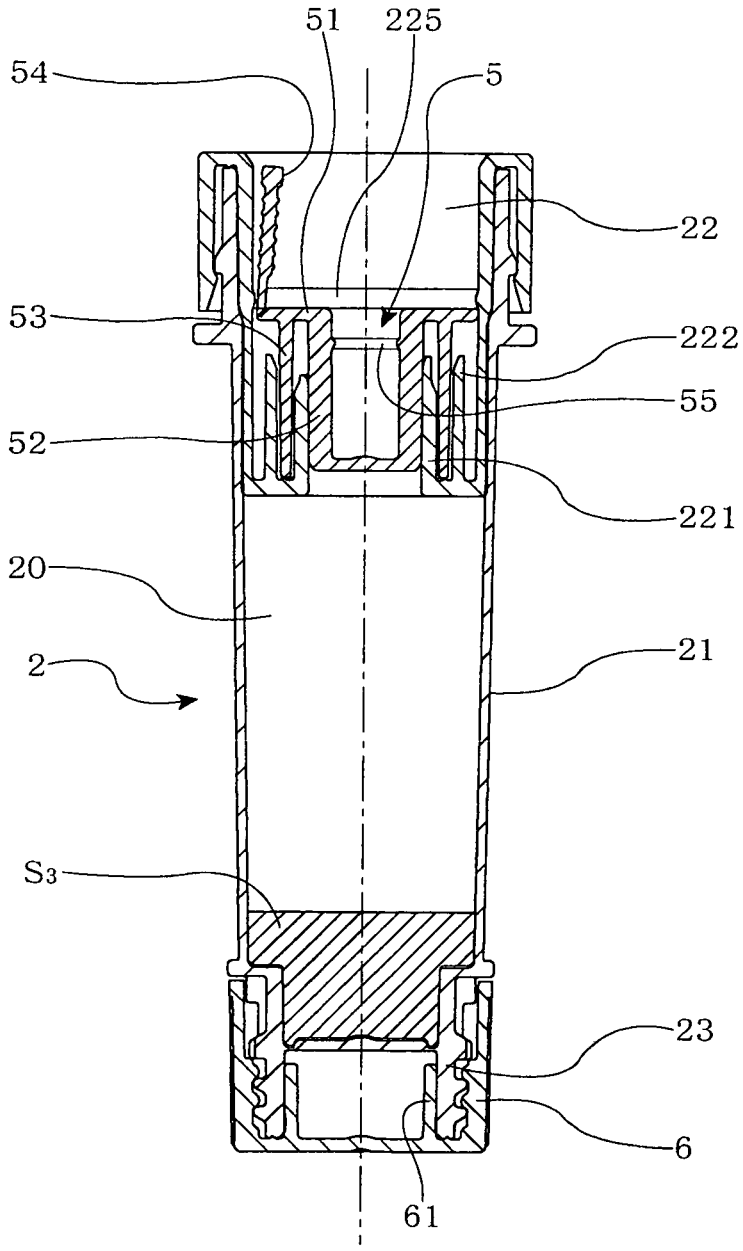
FIG. 3 is an explanatory view showing an example in which a sealing element and a protecting element are installed in the container main body shown in FIG. 1.

FIG. 3 is an explanatory view showing the state in which contents S3 are accommodated in the container main body 2 shown in FIG. 1 and the container main body 2 is sealed with a pouring element 5 and the protecting element 6 is attached to the contents outlet port 23.

As mentioned above, the compound container 1 according to this embodiment is comprised of five elements; that is, the container main body 2, the auxiliary container 3, the opening pouring element 4, the sealing element 5 and the protecting element 6.

In this embodiment, these elements can be produced by injection molding etc., for example, by using thermoplastic resin materials such as polyolefin-based resins, the specific examples of which include polypropylene and polyethylene and engineering plastics such as polyacetal and polybutylene terephthalate. Each member may be produced by using the same material. However, according to the difference in function or the like which is required for each element, the material to be used may be differed appropriately. Each element may be colored for light-shielding purpose. In order to allow the accommodated contents to be visible from the outside, each element may be transparent or semi-transparent.

Next, the detailed structure of each of the above-mentioned elements will be explained mainly and in the order of the auxiliary container 3, the container main body 2 and the opening pouring element 4.

[Auxiliary Container]

The auxiliary container 3 is provided with a cylindrical trunk part 31 in which one end side (the upper side in the figure) is rendered as the opening part and the other end side (the lower side in the figure) is blocked by a second accommodation chamber partition wall 30*a* which partitions part of the second accommodation chamber 30 and a lid 32 which seals the second accommodation chamber 30 partitioned by the trunk part 31 and the second accommodation chamber partition wall 30*a*.

As shown in the figure, in the second accommodation chamber partition wall 30*a*, the peripheral edge which is in contact with the inner surface of the trunk part 31 is rendered thin. When the auxiliary container 3 is mounted on the mounting part 22 of the container main body 2, it is cut by a cutting part 221 formed on the mounting part 22 of the container main body 2, mentioned later, along the thinned peripheral edge.

At this time, it is preferred that the second accommodation chamber partition wall 30*a* be not separated from the trunk part 31 and dropped. More specifically, it is preferred that the second accommodation chamber partition wall 30*a* which has been cut be disposed between the inner surface of the trunk part 31 and the cutting part 221 formed on the side of the container main body 2, while keeping the state in which the second accommodation chamber partition wall 30*a* is partially connected with the inner surface of the trunk part 31 (see FIG. 8 (*c*) or the like given later).

For this purpose, it suffices that a relief part be formed by narrowing the outer diameter of the side of the cutting part 221 nearer to the front end, and the position at which the second accommodation chamber partition wall 30*a* is formed be determined so that the second accommodation chamber partition wall 30*a* is disposed in a gap formed between this relief part and the inner surface of the trunk part 31, while keeping the state where it is partially connected to the inner surface of the trunk part 31, taking into consideration the dimension or the like of the cutting part 221 formed on the side of the container main body 2. In the shown example, the second accommodation chamber partition wall 30*a* is formed in the position which is directed inwardly for a predetermined length from the front end portion of the other end of the trunk part 31, taking into consideration the relative positional relationship with the cutting part 221 formed in the side of the container main body 2 when the auxiliary container 3 is mounted on the mounting part 22 of the container main body 2.

Here, a part ranging from the position where the second accommodation room partition wall 30*a* is formed to the front end portion of the other end of the trunk part 31 will be referred to as the cylindrical pendent part 312.

The lid 32 is detachably attached to the opening of the trunk part 31, thereby to seal the second accommodation chamber 30 formed in the auxiliary container 3 so that the accommodated contents may not be leaked outside.

In the shown example, the lid 32 is formed of an outer cylindrical part 321, an inner cylindrical part 322, and a top plate part 323. A thread part is formed on the outer peripheral surface on the opening portion side of the trunk part 31 and on the inner peripheral surface of the outer cylindrical part 321 of the lid 32, whereby the lid 32 is attached to the trunk part 31 by thread engagement. At the same time, when the lid 32 is attached to the trunk part 31, the outer peripheral surface of the inner cylindrical part 322 is allowed to be in close contact with the inner peripheral surface of the trunk part 31, thereby to enhance the sealing performance thereof.

In addition, in the shown example, the lid 32 is allowed to be attached to the trunk part 31 by the thread engagement. Methods for attaching the lid 32 to the trunk part 31 may be replaced by suitable alternative methods such as capping.

Furthermore, in order to improve sealing performance when the lid 32 is attached to the trunk part 31, it is preferred that cyclic projections which contact the front end surface of the peripheral edge of the trunk part 31 be formed in the corresponding position on the side of the lid 32. In this way, even if the contents are leaked from a gap between the outer peripheral surface of the inner cylindrical part 322 and the inner peripheral surface of the trunk part 31, further leakage can be prevented by the front end surface of the peripheral edge of the opening part of the trunk part 31 and the cyclic projections which contact thereto.

Further, by forming a flange part 311 shown in the figure on the outer peripheral surface of the trunk part 31 of the auxiliary container 3 along the circumferential direction, not only the rigidity thereof is improved, but also the auxiliary container 3 is prevented from being withdrawn when mounted on the mounting part 22 of the container main body 2. Furthermore, by subjecting the outer peripheral surface of the other end side of the trunk part 31 (cylindrical pendant part 312) and the outer peripheral surface of the outer cylindrical part 321 of the lid 32 to knuring, these surfaces can serve as an anti-slipping element when the lid 32 is attached to or detached from the trunk part 31 by thread engagement.

[Container Main Body]

The container main body 2 has a cylindrical trunk part 21. A mounting part 22 on which the auxiliary container 3 is mounted is provided on the one end side (the upper end side in the figure) of this trunk part 21. Further, the contents outlet port 23 is provided in the other end side (the lower end side in the figure) of the trunk part 21. The opening pouring element 4 is mounted on this contents outlet port 23.

Figure 4:
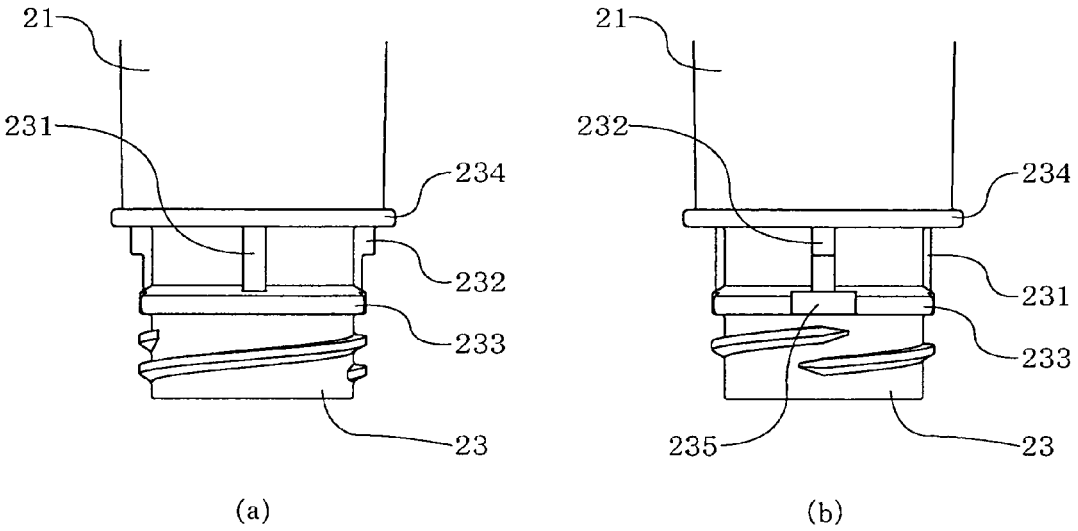
FIG. 4 is an explanatory view noting the contents outlet port of the container main body shown in FIG. 1.

FIG. 4 is an explanatory view noting the contents outlet port 23. FIG. 4(*a*) is a front view as viewed from the same direction as in the example shown in FIG. 1. FIG. 4(*b*) is a side view as viewed from the side when rotated by 90 degrees around the axis from the state shown in FIG. 1.

The mounting part 22 is provided with the cutting part 221 which cuts the second accommodation chamber partition wall 30*a* which partitions part of the second accommodation chamber 30 formed in the auxiliary container 3 when the auxiliary container 3 is mounted. As shown, the cutting section 221 can be formed into a shape which is obtained by obliquely cutting the front end side of the cylindrical part which rises in parallel with the axial direction, for example. In this way, cutting is started by the intrusion of the front end of the cutting part 221 to the second accommodation chamber partition wall 30*a* when the auxiliary container 3 is mounted on the mounting part 22. Furthermore, if the auxiliary container 3 is pushed in, the periphery of the second accommodation chamber partition wall 30*a* is gradually cut. Here, as mentioned above, the outer diameter of part nearer to the front end of the cutting part 221 is narrowed, thereby to form a relief part.

Moreover, a cylindrical sealing cylinder 222 which rises concentrically with the cutting part 221 is formed in the outer peripheral side of the cutting section 221. When mounting the auxiliary container 3 on the mounting part 22, after the outer peripheral surface of the cutting part 221 is in close contact with the inner peripheral surface of the trunk part 31 of the auxiliary container 3, cutting of the second accommodation chamber partition wall 30*a* by the cutting part 221 is started. Subsequently, the inner peripheral surface of the cylindrical sealing cylinder 222 is in close contact with the outer peripheral surface of the trunk part 31 of the auxiliary container 3, and cutting of the second accommodation chamber partition wall 30*a* is conducted in this state.

Thus, when the auxiliary container 3 is mounted on the mounting part 22, the outer peripheral surface of the cutting section 221 is in close contact with the inner peripheral surface of the trunk part 31 of the auxiliary container 3, and the inner peripheral surface of the sealing cylinder 222 is in close contact with the outer peripheral surface of the trunk part 31 of the auxiliary container 3, whereby the cylindrical pendant part 312 side of the auxiliary container 3 is disposed by the cutting part 221 and the sealing cylinder 222. By appropriately adjusting the dimension such as the wall thickness, the sealing performance when the auxiliary container 3 is mounted on the mounting part 22 and the second accommodation chamber partition wall 30*a* is cut can be enhanced.

Moreover, the circular projection 225 which circularly projects along the circumferential direction is formed on the inner peripheral surface of the mounting part 22. This circular projection 225 is engaged with the flange part 311 formed in the trunk part 31 of the auxiliary container 3 when the auxiliary container 2 is mounted on the mounting part 22, thereby preventing the auxiliary container 3 from being dropped.

The mounting part 22 which is to be provided on the container main body 2 may be integrally formed with the trunk part 21. In the shown example, the trunk part 31 and the mounting part 22 are provided separately, and the container main body 2 is formed by attaching the mounting part 22 to the trunk part 21.

As mentioned later, when the contents are taken out of the compound container 1, the container main body 2 is squeezed, thereby allowing an appropriate amount of the contents to be dripped from a pouring port 411 of the opening pouring member 4 (see FIG. 9(*c*) which will be given later). Therefore, it is desired that the container main body 2 be formed of a flexible material which can be squeezed. When the mounting part 22 is formed of a flexible material, it may become difficult to ensure the sealing performance for the auxiliary container 3 which is to be mounted on the mounting part 22. For this reason, in order to form the trunk part 21 of a flexible material which can be squeezed, and in order to allow the mounting part 22 to be formed of a relatively hard material taking into consideration the sealing performance with the auxiliary container 3, it is preferred that the trunk part 21 and the mounting part 22 be separated. In addition, if the mounting part 22 is formed of a relatively hard material, the rigidity of the cutting part 221 formed in the mounting part 22 can also be secured. It is preferable to ensure the cutting by the cut section 221 of the second accommodation chamber partition wall 30*a* of the auxiliary container 3.

In the shown example, the mounting part 22 has an inner cylindrical part 224 which rises on the outer peripheral side of the sealing cylinder 222 and is in close contact with the inner peripheral surface of the trunk part 21, and an outer cylindrical part 223 which it is turned back by the front end side of this inner cylindrical part 224 and elongates vertically. As shown, the mounting part 22 has a configuration in which the circular projection formed on the front end side of the inner peripheral surface of the outer cylindrical part 223 is engaged with the circular projection formed on the front end side of the outer peripheral surface on the opening part side of the trunk part 21, whereby the mounting part 22 is fixed to the opening part of the trunk part 21.

At this time, the sealing performance between the trunk part 21 and the mounting part 22 is enhanced by allowing the outer peripheral surface of the inner cylindrical part 224 to be in close contact with the inner peripheral surface of the trunk part 21. In order to improve the sealing performance between them, it is preferable to form the circular projection which contacts the front end surface of the peripheral edge of the opening of the trunk part 21 at the corresponding position on the mounting part 22. Due to such a configuration, even if the contents are leaked from a gap between the outer peripheral surface of the inner cylindrical part 224 and the inner peripheral surface of the trunk part 21, further leakage can be prevented by the front end surface on the peripheral edge of the opening of the trunk part 21, and the cyclic projection which contact thereto.

Moreover, in the shown example, the contents outlet port 23 is formed such that the inner diameter thereof is smaller than the inner diameter of the trunk part 21. The main purpose of this configuration is, when squeezing the container main body 2 to take the contents out, to allow a back pressure to act on effectively on the contents. By allowing the inner diameter of the contents outlet port 23 to be smaller than the inner diameter of the trunk part 21, the opening porting element 4 can be well accommodated within the contents outlet port 23.

Moreover, in the contents outlet port 23, a first cyclic rib 234 is formed in a boundary with the trunk part 21. A second cyclic rib 233 is formed at a position which is away for a predetermined distance from the first cyclic rib 234. Furthermore, between the first cyclic rib 234 and the second cyclic rib 233, a plurality of convex-shaped ribs 231, which are elongated in the axial direction and connect to the first cyclic rib 234 and the second cyclic rib 233, are formed at an equal angular space along the circumference direction. Although the rigidity of the contents outlet port 23 is secured by this, it is also effective to increase the thickness of the contents outlet port 23, as shown, in order to ensure the rigidity of the contents outlet port 23.

By securing the rigidity of the contents outlet port 23, when squeezing the container main body 2 to take the contents out, dropping of the opening pouring element 4 which is mounted on the contents outlet port 23 can be prevented, and at the same time, the sealing performance between them can be prevented from being deteriorated. That is, it is desired that the container main body 2 (in particular, the trunk part 21) be formed of a material which can be squeezed, in the shown example in which the contents outlet port 23 is integrally formed with the trunk part 21, it is preferred that the contents outlet port 23 have the above-mentioned structure, that is, a structure which can ensure the rigidity, thereby to prevent the dropping of the opening pouring element 4, and the sealing performance when the opening pouring element 4 is installed in the contents outlet port 23 be not deteriorated.

In addition, as in the case of the above-mentioned mounting part 22, the rigidity of the contents outlet port 23 can be secured by allowing it to be provided separately from the trunk part 21 and forming it of a relatively hard material. However, from the viewpoint of reducing the number of components, like the shown example, it is preferred that the contents outlet port 23 be formed integrally with the trunk part 21.

Moreover, the contents outlet port 23 is blockaded by the first accommodation chamber partition wall 20*a* which partitions a part of the first accommodation chamber 20.

As shown, the peripheral edge of the first accommodation chamber partition wall 20*a* which contacts the inner peripheral surface of the contents outlet port 23 have a smaller thickness. When the opening pouring element 4 is mounted on the contents outlet port 23, the first accommodation chamber partition wall 20*a* is cut by a cutting part 42 (mentioned later) which is formed in the opening pouring element 4 along the peripheral edge which is rendered thin. At this time, it is preferred that the first accommodation chamber partition wall 20*a* be not separated and dropped from the contents outlet port 23. More specifically, it is preferred that the first accommodation chamber partition wall 20*a* which has been cut be disposed between the inner peripheral surface of the contents outlet port 23 and the cutting part 42 formed on the opening pouring member 4 side while keeping the state that it is partially connected to the inner peripheral surface of the contents outlet port 23 (see FIG. 9(*b*) or the like, which will be given later).

For this purpose, the outer diameter of the front end side of the cutting part 42 formed on the opening pouring element 4 is narrowed to form a relief part, the position at which the first accommodation chamber partition wall 20*a* is formed may be determined taking into consideration the dimension or the like of the cutting part 42 formed on the side of the opening pouring element 4 such that the first accommodation chamber partition wall 20*a* which has cut is disposed in a gap formed between this relief part and the inner peripheral surface of the contents outlet port 23 while keeping the state where the first accommodation chamber partition wall 20*a* is partially connected with the inner peripheral surface of the contents outlet port 23. In the shown example, taking into consideration the relative positional relationship with the cutting part 42 formed on the opening pouring element 4 side when the opening pouring element 4 is mounted on the contents outlet port 23, the first accommodation chamber partition wall 20*a* is formed at a position which is directed inwardly for a predetermined length from the front end of the contents outlet port 23.

When the opening pouring element 4 is mounted on the contents outlet port 23, the opening pouring element 4 may be mounted by capping. However, in the shown example, the opening pouring element 4 is mounted on the contents outlet port 23 by thread engagement.

When the opening pouring element 4 is mounted on the contents outlet port 23 by thread engagement, in the shown example, of the four convex-shaped ribs 231 formed in the contents outlet port 23, as for two convex-shaped ribs 231 opposing in the radial direction, a whirl-stop 232 is provided in a projected manner on the side which links to the first cyclic rib 234. At the same time, the two notched parts 235 for positioning which oppose to the radial direction are formed at a position on the second cyclic rib 233 which overlaps the whirl stop 232 (see FIG. 4(*b*)). On the inner peripheral surface of the front edge of the outer cylindrical part 41 of the opening pouring element 4, two positioning projections 412 which are opposed in the radial direction are formed such that the length thereof along the circumferential direction becomes almost the same as the notch width of the notched part 235 for positioning formed in the second cyclic rib 233 of the contents outlet port 23.

When mounting the opening pouring element 4 on the contents outlet port 23, the opening pouring element 4 is pushed in while conducting the positioning of the notched part 235 for positioning and the positioning projection 412, and when the positioning projection 412 passes over the second cyclic rib 233, the front end of the cutting part 42 formed on the side of the opening pouring element 4 enters the first accommodation partition wall 20*a*, and the cutting thereof starts. Further, when screwing of the opening pouring element 4 starts, the peripheral edge of the first accommodation partition wall 20*a* is gradually cut. Furthermore, when the opening pouring element 4 makes almost a half turn, the positioning projection 412 contacts the whirl stop 232, and a further rotation of the opening pouring element 4 is prevented. The first accommodation chamber partition wall 20*a* is disposed between the inner peripheral surface of the contents outlet port 23 and the cutting part 42 formed on the side of the opening-pouring-element 4, keeping the state where the first accommodation partition wall 20*a* partially connects to the inner peripheral surface of the contents outlet port 23.

The specific embodiment of mounting the opening pouring element 4 is not limited, and the installation may be conducted by capping, as mentioned before. That is, the opening pouring element 4 may be mounted on the contents outlet port 23 only by pushing the opening pouring element 4, and simultaneously with this, the first accommodation chamber partition wall 20*a* is allowed to be cut. At this time, taking into consideration the relative positional relationship of the cutting part 42 formed in the opening pouring element 4 which is mounted on the contents outlet port 23 and the first accommodation chamber partition wall 20*a*, it is preferred that the shape of the cutting part 42 formed in the opening pouring element 4 be devised to allow the amount of the opening pouring element 4 to be pushed to the first accommodation chamber partition wall 20*a* is adjusted, whereby the first accommodation chamber partition wall 20*a* is cut in the state where it is partially connected with the inner peripheral surface of the contents outlet port 23.

During the use, the auxiliary container 3 and the opening pouring element 4 are mounted on the above-mentioned container main body 2. As mentioned above, the sealing element 5 is detachably attached to the mounting part 22, whereby the second accommodation chamber 30 formed in the container main body 2 can be sealed so that the contents accommodated may not be leaked outside. Furthermore, in order to prevent breakage or the like of the first accommodation chamber partition wall 20*a*, a protection element 6 may be attached to the contents outlet port 23 of the container main body 2.

In the example shown in FIG. 3, the sealing element 5 is detachably attached to the mounting element 22 in the state that the outer peripheral edge of a cyclic top plate part 51 is engaged with the circular projection 225 formed on the inner peripheral surface of the mounting part 22. By pulling it out by using a knob piece 54, the engagement with the circular projection 225 is cancelled, whereby the sealing element 5 is removed from the mounting part 22. Furthermore, the sealing element 5 has the sealing part 52 which vertically elongates from the inner circumferential edge of the top plate part 51 in the form of a closed-bottom cylinder and is in close contact with the inner peripheral surface of the cutting part 221 formed in the mounting part 22 and the cylindrical pendant part 53 which vertically elongates from the top plate 51 such that it is in contact with and disposed between the cutting part 221 formed in the mounting part 22 and the sealing cylinder 222. The second accommodation chamber 20 formed in the container main body 2 is sealed by these.

The sealing element 5 not only seals the container main body 2 at the time of distribution and storage before use, but also, in order to prevent the leakage of the contents remaining in the container outside during a disposal treatment, it can be attached so that a pouring port 411 of the opening pouring element 4 is covered.

Figure 10:
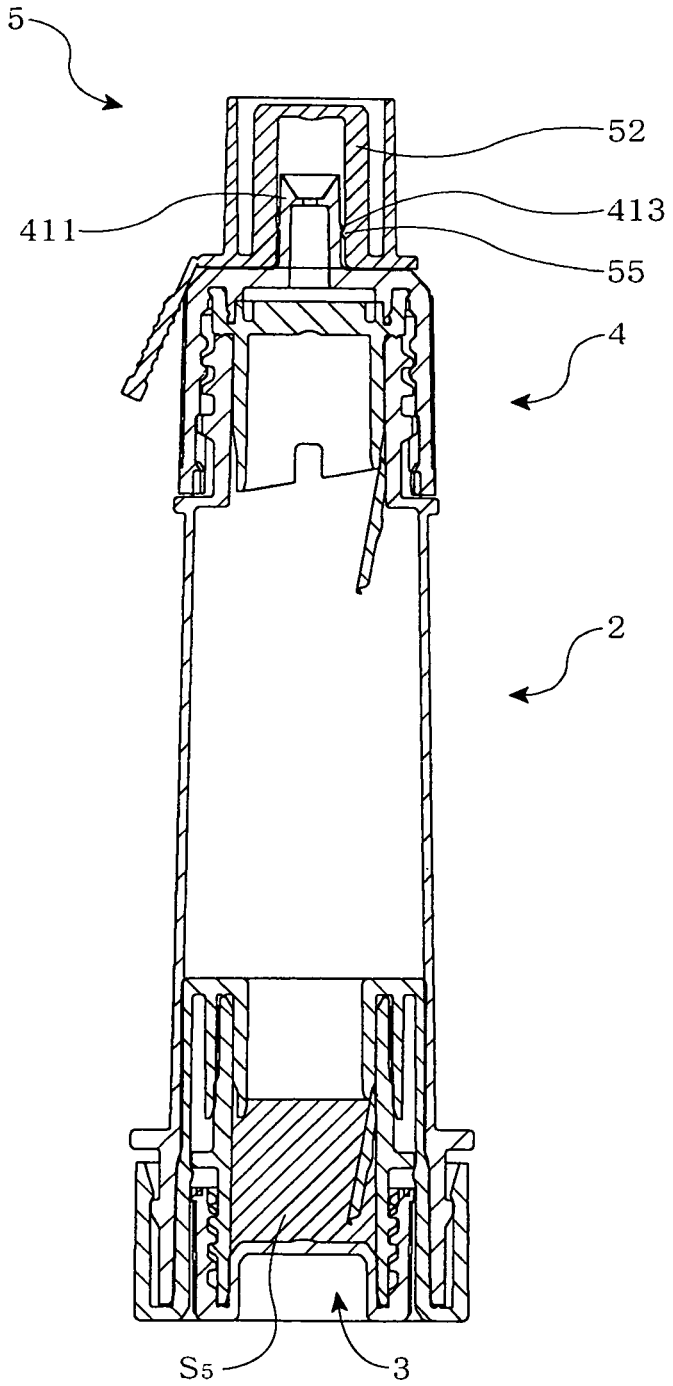
FIG. 10 is an explanatory view showing the form at the time of conducting a disposal treatment of the inspection container according to the first embodiment of the invention.

That is, the inner diameter of the sealing part 52 of the sealing element 5 is formed in correspondence with the outer diameter of the pouring port 411 of the opening pouring element 4, and at the same time, a circular projection 55 is formed on the inner surface of the sealing part 52. In this way, the pouring port 411 of the opening pouring element 4 is inserted into the sealing part 52 of the sealing element 5. By engaging a circular projection 413 formed on the outer peripheral surface of the pouring port 411 with the circular projection 55 formed on the inner peripheral surface of the sealing part 52, the sealing element 5 can be attached such that it covers the pouring port 411 of the opening pouring element 4 (see FIG. 10, given later).

Moreover, the protection element 6 can be formed as a screw cap which has a cylindrical part 61 which is in close contact with the inner peripheral surface on the front end side of the contents outlet port 23. The cylindrical part 61 may be omitted according to need, and the protection element 6 may be attached to the contents outlet port 23 by capping. In order to improve sealing performance when the protection element 6 is attached to the contents outlet port 23, not only the cylindrical part 61 is formed, but also a circular projection which contacts the front end side of the contents outlet port 23 may be formed at a corresponding position on the protection element 6.

[Opening Pouring Element]

The opening pouring element 4 has an outer cylindrical part 41 in which the pouring port 411 is formed, a cutting part 42 to be attached to the inside of the outer cylindrical part 41 and a filter 43 disposed between the outer cylindrical part 41 and the cutting part 42.

Figure 5:
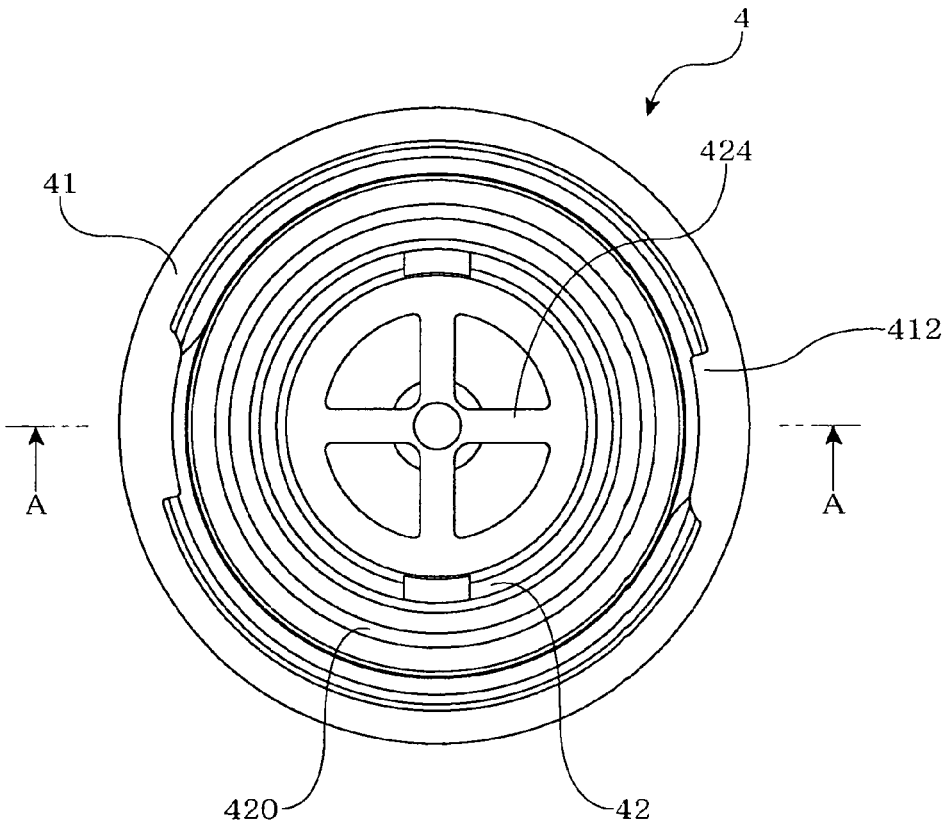
FIG. 5 is a plan view of an opening pouring element shown in FIG. 1.
Figure 6:
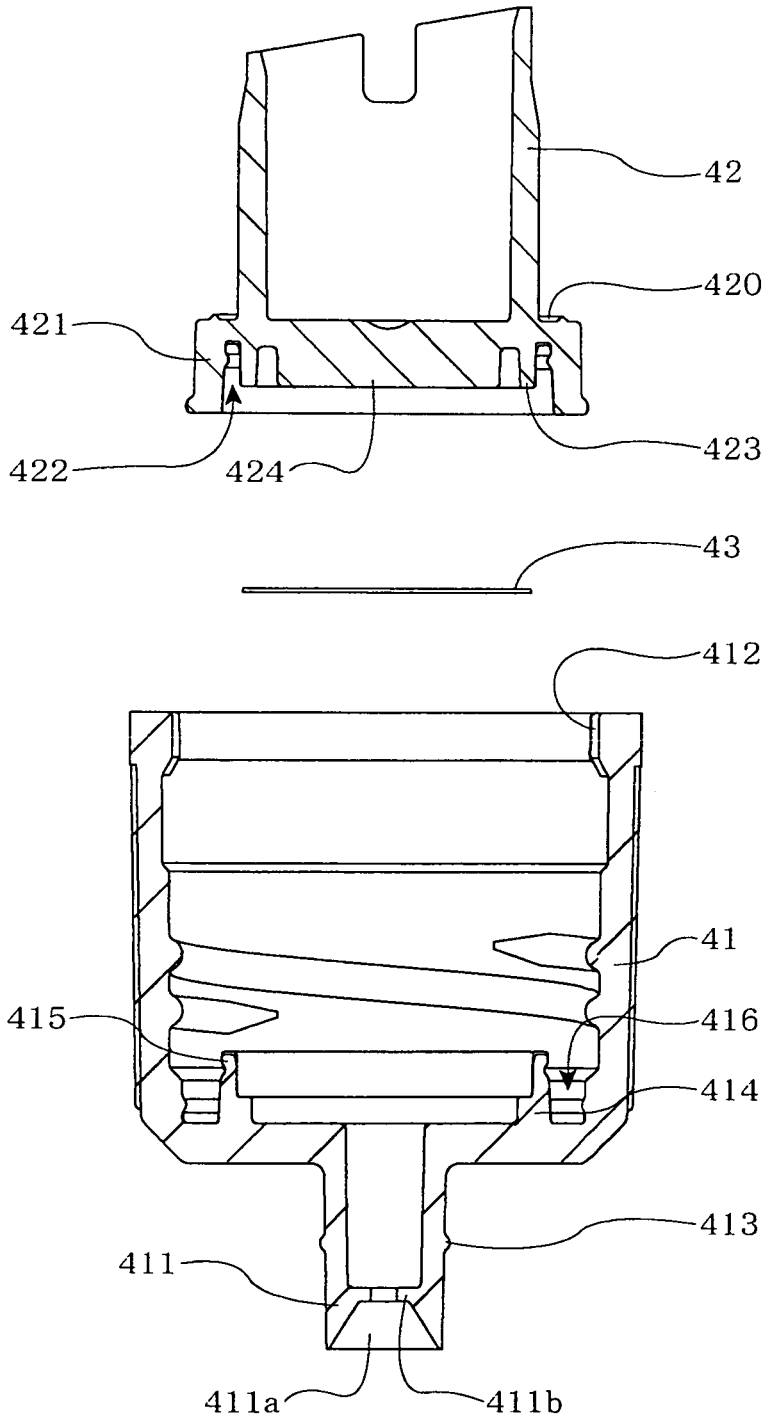
FIG. 6 is an exploded cross-sectional view of the opening pouring element shown in FIG. 1.

FIG. 5 is a plan view of the opening pouring element 4, and FIG. 6 is an exploded cross sectional view taken along the line A-A in FIG. 5.

As shown, in the outer cylindrical part 41, a supporting part 414 for supporting the peripheral edge of the filter 43 which is formed in a circular shape is formed concentrically with the pouring port 411. At the same time, an engagement projection 415 which projects in the axial direction is formed along the outer peripheral edge of the supporting part 414. Further, on the outer peripheral side of the supporting part 414, an engagement groove 416 is circularly formed.

In the shown example, as mentioned above, the opening pouring element 4 is allowed to be mounted by thread engagement at the contents outlet port 23 of the container main body 2. The outer peripheral surface of the outer case part 41 is subjected to knuring, thereby to allow it to serve as an anti-slipping element when mounting the opening pouring element 4 to the contents outlet port 23 of the container main body 2 by thread engagement.

On the other hand, as shown, the cutting part 42 can be formed into a shape obtained by obliquely cutting the front end side of the cylindrical part which rises in a direction parallel with the axial direction. On the base side of the cutting part 42, a cyclic engagement part 421, an engagement groove part 422, a cyclic filter pressing part 423 and a cross-shaped filter pressing part 424 are formed.

Here, when mounting the opening pouring element 4 in the contents outlet port 23 of the container main body 2, as mentioned above, the cutting part 42 cuts the first accommodation chamber partition wall 20*a* which blocks the contents outlet port 23 of the container main body 2, and at this time, the outer diameter of the front end side of cutting part 42 is narrowed, whereby a relief part is formed.

Moreover, when the cutting part 42 cuts the first accommodation chamber partition wall 20*a* of the container main body 2, the outer peripheral surface of the cutting part 42 is in close contact with the inner peripheral surface of the contents outlet port 23 of the container main body 2 so as to seal the gap between them. In order to improve the sealing performance at this time, as shown, it is preferable to form the cyclic projection 420 which contacts the front end surface of the contents outlet port 23 at a corresponding position on the side of the opening pouring element 4 concentrically with the cutting part 42. In this way, even if the contents are leaked out from a gap between the cutting part 42 and the contents outlet port 23 of the container main body 2, further leakage can be prevented by the front end surface of the contents outlet port 23 and the cyclic projection 420 which contacts thereto.

From the state shown in FIG. 6, if the cutting part 42 is attached to the outer cylindrical part 41 with a filter 43 being interposed therebetween, the engagement projection 415 of the outer cylindrical part 41 is engaged with the engagement groove 422 formed on the base side of the cutting part 42, and the cyclic engagement part 421 formed on the base side of the cutting part 42 is engaged with the engagement groove 416 of the outer cylindrical part 41. As a result, the cutting part 42 can be fixed in the outer cylindrical part 41 by the supporting part 414 formed in the outer cylindrical part 41 and the circular filter pressing part 423 formed on the base side of the cutting part 42, while the periphery of the filter 43 is kept by the supporting part 414 formed in the outer cylindrical part 41 and the circular filter pressing part 423 formed on the base side of the cutting part 42.

Although not particularly shown, in order to prevent the cutting part 42 from rotating in the circumferential direction within the outer cylindrical part 41, it is preferred that the convex and concave shapes which are engaged with each other be formed at corresponding positions of the outer cylindrical part 41 and the cutting part 42. The configuration is not limited to that shown in the figure. Various filters may be built in the opening pouring element 4 in which the outer cylindrical part 41 and the cutting part 42 are integrally formed.

The filter 43 serves as a filter which filters the contents to remove unnecessary solid contents contained in the contents. As the filter 43, one which was formed by using various filtering materials can be used according to the contents which are to be filtered. It is preferable to use a membrane filter which enables precise filtration.

Moreover, from the pouring port 411 of the opening pouring element 4, a suitable amount of contents (a filtrate filtered by the filter 43) are allowed to be dripped when the container main body 2 is squeezed. For this reason, in the shown example, on the front end side of the pouring port 411, not only a narrowing part 411*b* which narrows down the opening area of the pouring port 411 is formed, but also a truncated cone-like concave part 411*a* is formed at the front end of the pouring port 411. By appropriately adjusting the volume of the concave part 411*a*, the gradient angle of the inner side surface of the concave part 411*a*, the opening area of the narrowing part 411*b*, or the like, the contents are allowed to be dripped after a predetermined amount of the contents (filtrate) is stored in the concave part 411*a*, whereby liquid droplets which have been quantified to several micro liters to several tens micro liters can be dripped.

As mentioned above, the cyclic projection 413 is formed in the outer peripheral surface of the pouring port 411, and at the time of disposal processing, the sealing element 5 can be attached so as to cover the pouring port 411.

Use Example

Next, as the use example of the above-mentioned compound container 1, in the LAMP method (see Non-Patent Document 1) which was previously proposed by one of the applicants of the invention, an example in which the container is used for preparing a sample (a sample for inspecting the presence of pathogenetic bacteria such as tubercle bacillus) which has been extracted from a subject will be explained.

Figure 7:
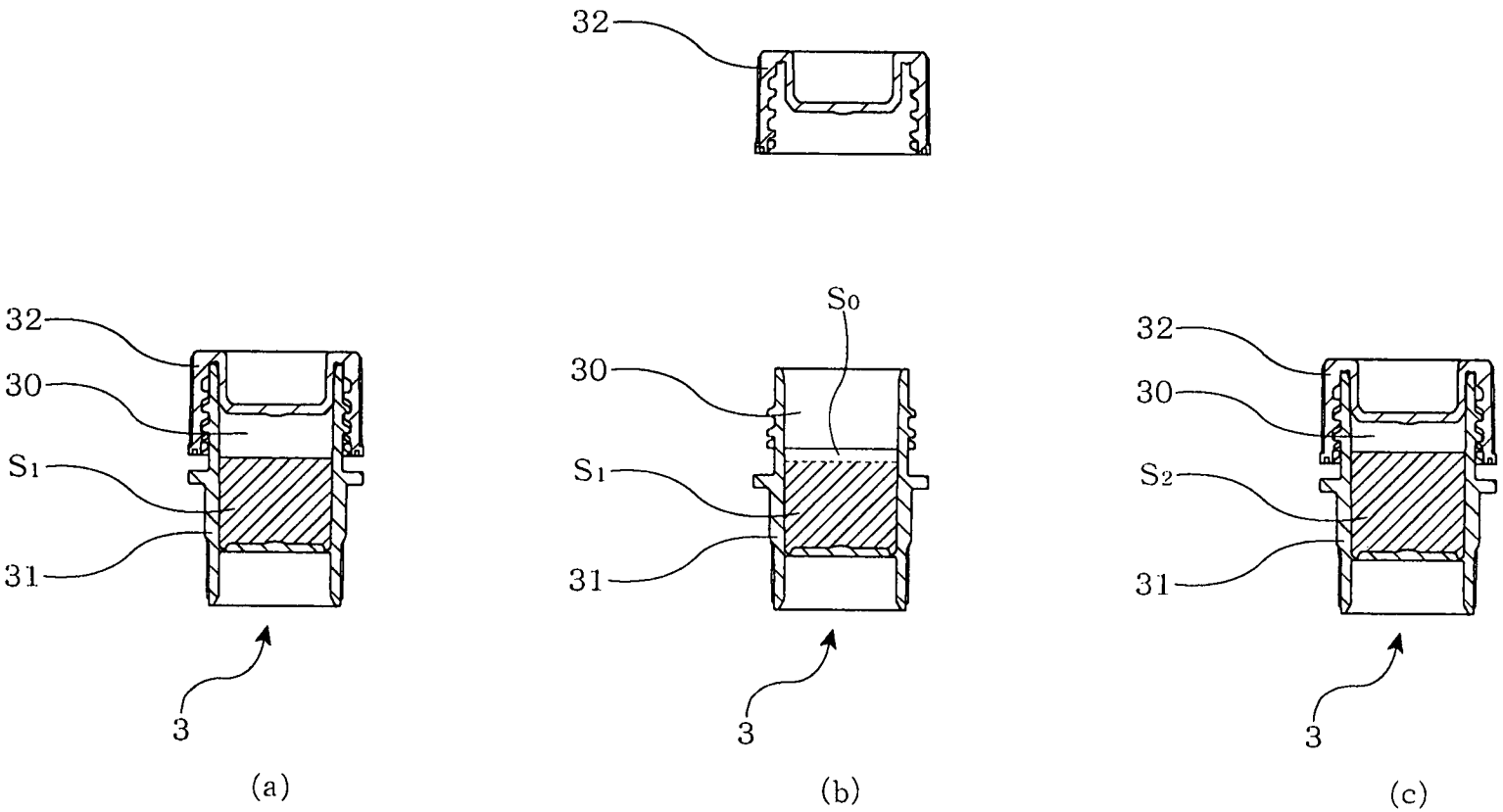
FIG. 7 is an explanatory view showing a step in the use example of the compound container according to the first embodiment of the invention.
Figure 8:
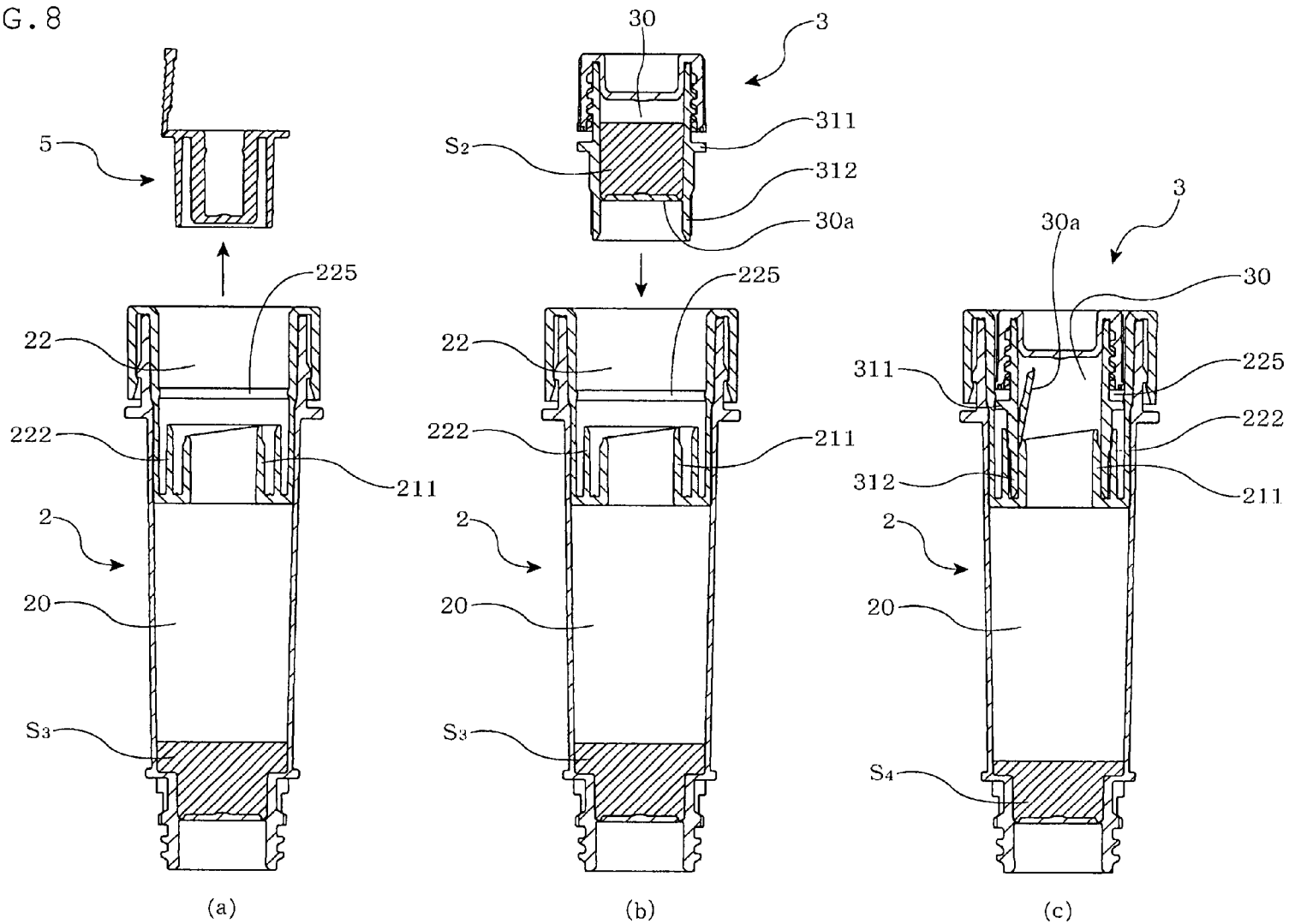
FIG. 8 is an explanatory view showing a step in the use example of the compound container according to the first embodiment of the invention.

Here, FIG. 7 is an explanatory view showing the process in which a sample S0 which has been extracted from a subject is added to the reagent S1 accommodated in the auxiliary container 3, followed by a heat treatment. FIG. 8 is an explanatory view showing the process in which an auxiliary container 3 is installed on the mounting part 22 of the container main body 2, allows the first accommodation chamber 20 and the second accommodation chamber 30 to be intercommunicated, and contents S2 in the heat-treated second accommodation chamber 30 are added to an adsorbent S3 accommodated in the first accommodation chamber 20, followed by stirring and mixing. FIG. 9 is an explanatory view showing the process in which the opening pouring element 4 is mounted on the contents outlet port 23 of the container main body 2, the contents S4 which become in the form of a slurry is filtered, and the filtrate (a sample preparation liquid) is dripped. FIG. 10 is an explanatory view showing the form at the time of conducting a disposal treatment while preventing the contents S5 remaining in the container from leaking outside by attaching the sealing element 5 so as to cover the pouring port 411.

In this use example, the adsorbent S3 is accommodated in the first accommodation chamber 20 of the container main body 2, and the container main body 2 is sealed by the sealing element 5 attached to the mounting part 22. Then, the container main body 2 with the sealing element 6 being attached to the contents outlet port 23 (see FIG. 3) is distributed and stored after being packed by a packing material formed of a non-moisture-permeable material such as aluminum pouch, if necessary.

Moreover, in the state where the reagent S1 is accommodated within the second accommodation chamber 30 (see FIG. 7(*a*)), and the auxiliary container 3 is distributed and stored after being packed by a packaging material formed of a non-moisture-permeable material such as aluminum pouch, if necessary.

In this use example, first, the lid 32 is removed from the auxiliary container 3. In the reagent S1 accommodated in the second accommodation chamber 30, the sample S0 which has been collected from a subject and processed appropriately, is added and re-sealed with the lid 32 (see FIGS. 7(*b*) and (*c*)). Subsequently, the auxiliary container 3 is transported to a heat treatment equipment, and the contents S2 obtained by adding the sample S0 to the reagent S1 are heated together with the auxiliary container 3, whereby tubercle bacillus which may be contained in the sample S0 is killed or inactivated.

Next, the sealing element 5 is removed from the container main body 2 (see, FIG. 8(*a*)). The auxiliary container 3 which has been subjected to a predetermined heat treatment is mounted on the mounting part 22 of the container main body 2 (see FIG. 8(*b*)). At this time, the second accommodation chamber partition wall 30*a* which partitions part of the second accommodation chamber 30 formed in the auxiliary container 3 is cut by the cutting part 221 formed in the mounting part 22, and the second accommodation chamber 30 is intercommunicated with the first accommodation chamber formed in the container main body 2.

As a result, the contents S2 which have been heat-treated in the auxiliary container 3 are flown into the first accommodation chamber 20, and added to the absorbent S3 in the container main body 2. By shaking or rubbing the container main body 2, the contents 2 and the adsorbent S3 are stirred and mixed to form the slurry-like contents S4 (see FIG. 8(*c*)), whereby part or all of unnecessary substances contained in the contents S2 are allowed to be adsorbed in the adsorbent S3.

In addition, as for the capacity of the trunk part 21 of the container main body 2, it is preferred that the container main body 2 be designed such that the stirring and mixing can be sufficiently conducted.

Figure 9:
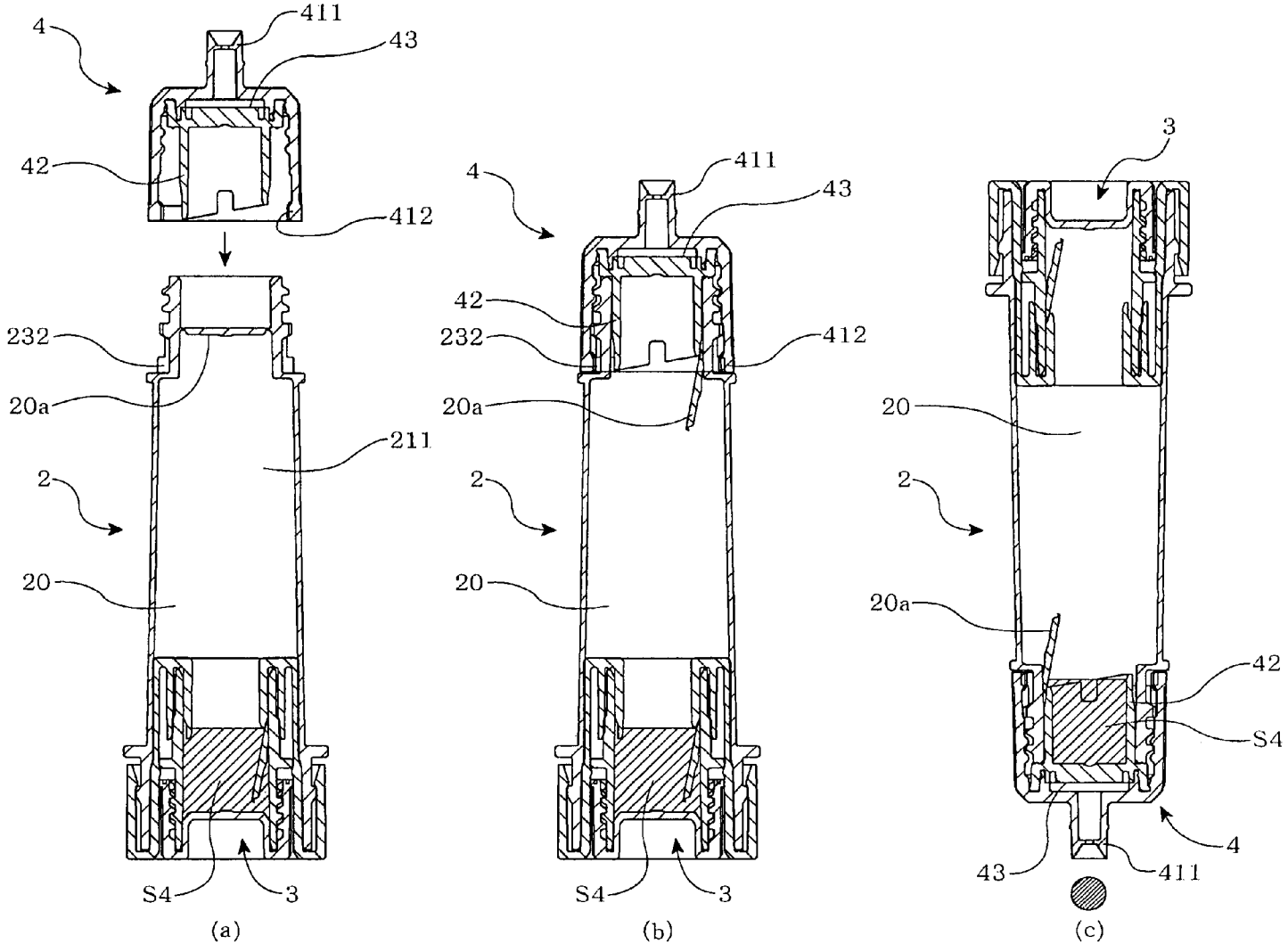
FIG. 9 is an explanatory view showing a step in the use example of the compound container according to the first embodiment of the invention.

Thereafter, the container main body 2 is inverted, and while the contents S4 are keeping away from the contents outlet port 23 (see FIG. 9(*a*)), opening pouring element 4 is mounted on the contents outlet port 23. By the cutting part 42 formed on the opening pouring element 4 side, the first accommodation chamber partition wall 20*a* is cut, whereby the container main body 2 is opened (see FIG. 9(*b*)). Then, the container main body 2, which has been turned upright again, is squeezed, and by applying a back pressure to the contents S4, a filtrate which has been quantified (in this use example, quantified to a small quantity of about 30 μl, for example) is dripped from the opening pouring port 411, while filtering the contents S4 by means of a filter 43 (see FIG. 9(*c*)).

By the above-mentioned preparation step, a preparation liquid of the sample S0 is obtained, and this liquid is then subjected to the following reaction process.

The sealing body 5 is attached to the used compound container 1 so that it covers the pouring port 411 (see FIG. 10), and is discarded while preventing the leakage of the contents S5 remaining in the container 1.

As for the compound container 1 according to this embodiment which can be used for the above-mentioned purpose, it is preferred that the container main body 2 be formed of a flexible material which can be squeezed. Since the auxiliary container 3 itself is not necessary to be formed of a flexible material, the auxiliary container 3 can be easily configured to have a structure in which the second accommodation chamber 30 is surely sealed such that the contents thereof are not leaked outside and the sealing performance thereof is not deteriorated by heating.

That is, the final extraction of the contents is conducted on the container main body 2 side, and the auxiliary container 3 can be designed noting mainly the sealing performance thereof. For this reason, it is easy to allow the auxiliary container 3 to have a structure fully sealed so that the contents may not be leaked outside, and, even if exposed to any other treatments than those for the container main body 2, it is easy not to cause the sealing performance thereof to be deteriorated. Further, it becomes possible to mix the contents sealed within the chambers 20 and 30 formed in each of the container main body 2 and the auxiliary container 3, while keeping the state where the contents are isolated from the outside environment.

Thus, the sample S0 which has been added to the auxiliary container 3 can allow all the treatments to be finished within the sealed compound container 1, without being exposed to the outer environment until the preparation process is completed. In this way, according to the compound container 1 according to this embodiment, leakage of pathogenetic bacteria such as tubercle bacillus which may be contained in the sample S0 can be effectively prevented, whereby the safety of a tester can be ensured and prevention of contamination of the outside environment can be prevented.

Furthermore, after the first accommodation chamber partition wall 20*a* formed in the contents outlet port 23 of the container main body 2 is cut and unsealed, while filtering the contents by means of the filter 43, a necessary amount of contents can be dripped from the pouring port 411 formed in the opening pouring element 4.

Second Embodiment

Then, the second embodiment of the invention will be explained.

Figure 11:
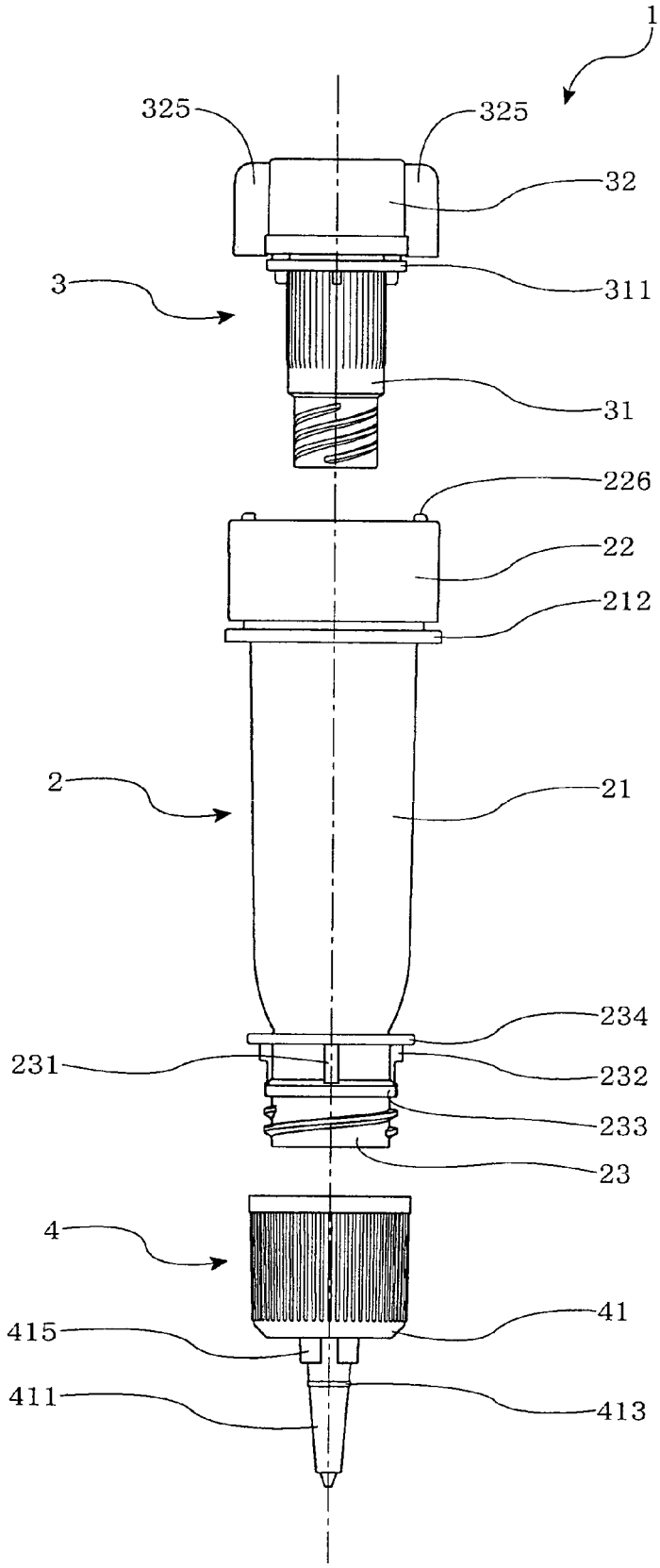
FIG. 11 is a schematic exploded view showing the second embodiment of the compound container of the invention.
Figure 12:
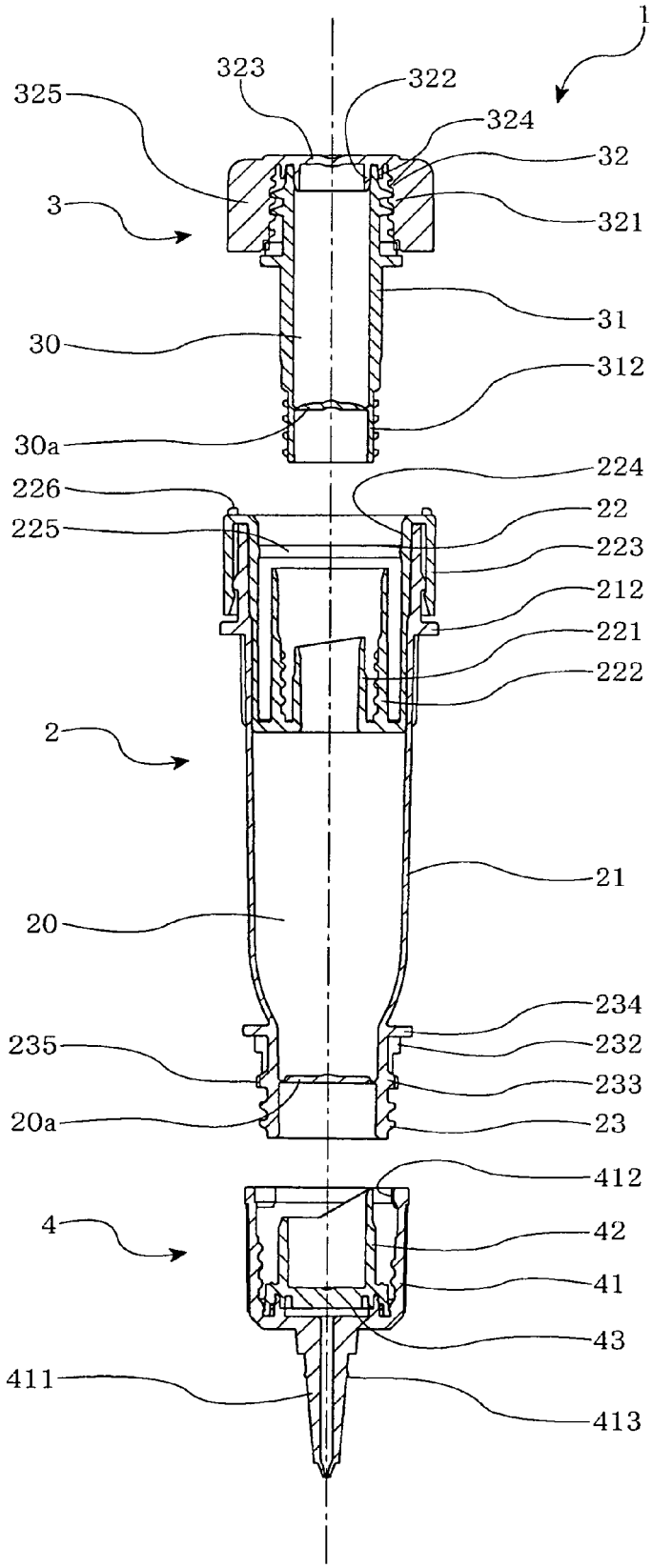
FIG. 12 is a schematic exploded view showing the second embodiment of the compound container of the invention.
Figure 13:
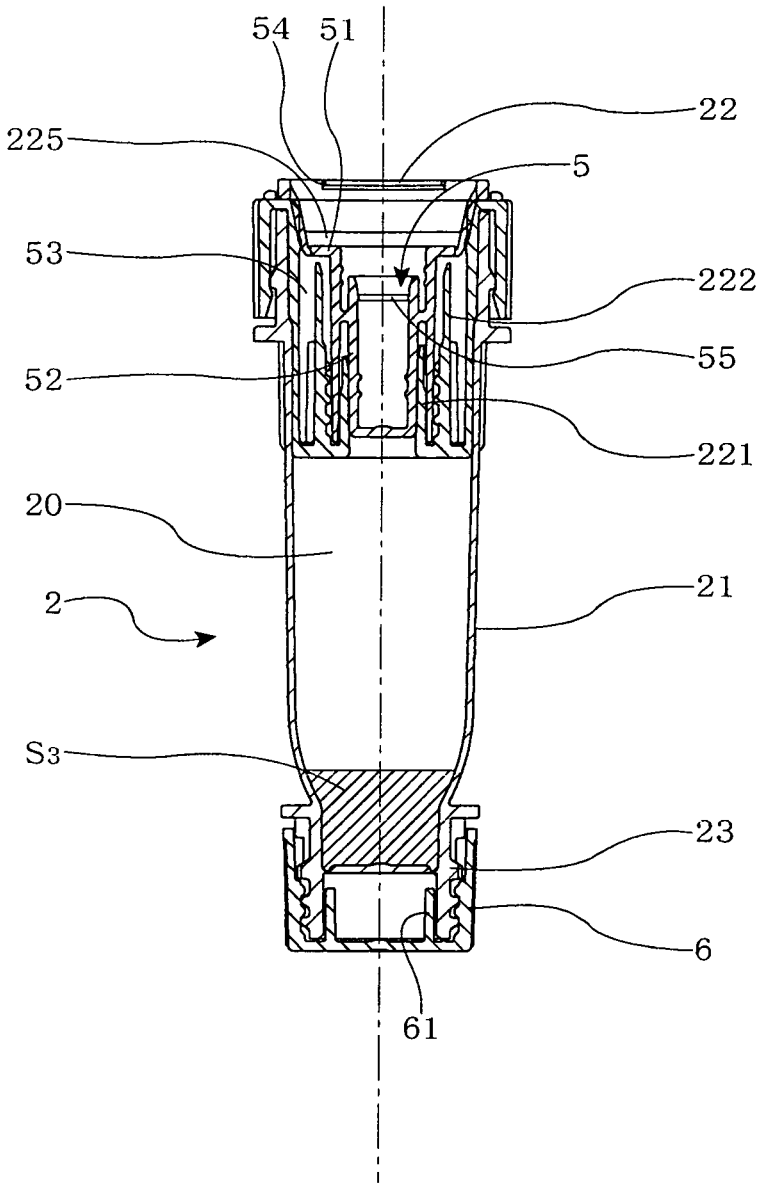
FIG. 13 is an explanatory view showing an example in which a sealing element and a protecting element are installed in the container main body shown in FIG. 11.

FIG. 11 is an exploded view showing the outline of one example of the compound container according to this embodiment. FIG. 12 is a cross-sectional view obtained by cutting off by a plane parallel to the paper including the central axis of the compound container 1 shown by the dashed line in FIG. 11. FIG. 13 is an explanatory view showing the state where the contents S3 are accommodated within the container main body 2 of in FIG. 11, followed by sealing by the sealing element 5, and the protection component 6 is attached to the contents outlet port 23.

As in the case of the above-mentioned first embodiment, the compound container 1 according to this embodiment is also comprised of five elements, that is, the container main body 2, the auxiliary container 3, the opening pouring element 4, the sealing element 5, and the protection element 6. As for the constitution which is common to the first embodiment, the same parts are indicated by the same symbols, and the explanation thereof is omitted. An explanation is made mainly on the points different from those of the first embodiment.

First, in the above-mentioned first embodiment, the auxiliary container 3 is mounted to the mounting part 22 of the container main body 2 such that it is pushed in. In order to reduce the power necessary for cutting the second accommodation chamber partition wall 30*a* at the time of mounting the auxiliary container 3, in this embodiment, the auxiliary container 3 is mounted by thread engagement. For this reason, the thread parts which are engaged with each other are provided on the front end side of the trunk part 31 of the auxiliary container 3 and the sealing cylinder 222 of the mounting part 22 of the container main body 2. The sealing cylinder 222 of the mounting part 22 is extended upwardly by providing the thread part in the base side, thereby allowing an area which is in close contact with the outer peripheral surface of the trunk part 31 of the auxiliary container 3 to be fully ensured.

Moreover, in the lid 32 of the auxiliary container 32 of this embodiment, a pair of extending parts 325 as shown in the figure are formed so that it can tightly be bound with a less strength when the auxiliary container 32 is mounted by thread engagement. A projection 226 which contacts the end position of screwing is projected on the upper surface of the mounting part 22. As a result, in this embodiment, when the auxiliary container 3 is mounted by thread engagement, the lid 32 projects on the upper surface of the mounting part 22.

Moreover, in the above-mentioned first embodiment, as for the lid 32 of the auxiliary container 3, a top plate 323 is provided on the lower end side of the inner cylindrical part 322 which vertically elongates such that it is in close contact with the inner surface of the trunk part 31. Such embodiment is effective in reducing a head space when the reagent S1 or the like is accommodated in the auxiliary container 3 (see FIG. 7).

On the other hand, if there is no need to reduce the head space, as in this embodiment, the outer cylindrical part 321 in which the thread part is formed on the inner peripheral surface, and the inner cylindrical part 322 which is in close contact with the inner peripheral surface of the trunk part 31 are provided such that they elongate concentrically from the top plate 323, and at the same time, the cyclic projection 324 which sandwiches the peripheral end side of the opening of the trunk part 31 between it and the inner cylindrical parts 322 is provided. As a result, the sealing performance of the second accommodation chamber 30 formed in the auxiliary container 3 can be further improved. At this time, as in the first embodiment, it is preferred that the circular projection which contacts the front end of the peripheral edge of the opening of the trunk part 31 be formed at a corresponding position on the side of the lid 32.

Moreover, also in this embodiment, the sealing element 5 is detachably provided in the mounting part 22 by the engagement of the peripheral edge of the cyclic top plate part 51 is engaged in the circular projection 225 formed in the inner peripheral surface of the mounting part 22. By pulling out by means of the knob piece 54, the engagement with the circular projection 225 is cancelled, thereby to allow it to be removed from the mounting part 22.

The sealing element 5 of this embodiment differs from that in the first embodiment in that the sealing part 52 which is in close contact with the inner peripheral surface of the cutting part 221 provided in the mounting part 22 is connected to the inner peripheral surface of the cylindrical pendant part 53 and that the knob piece 54 is circular. It is the same as that in the first embodiment in that the second accommodation chamber 20 formed in the container main body 2 is sealed by the sealing part 52 and the cylindrical pendant part 53. As far as the second accommodation chamber 20 can be sealed, the specific shape thereof is not limited.

In this embodiment, by allowing the inner diameter of the contents outlet port 23 to be smaller than the inner diameter of the trunk part 21, the contents outlet port 23 side of the trunk part 21 is gradually narrowed, whereby no step is formed in the boundary between the trunk part 21 and the contents outlet port 23. In this way, no contents are remained in the boundary between the trunk part 21 and the contents outlet port 23.

Figure 14:
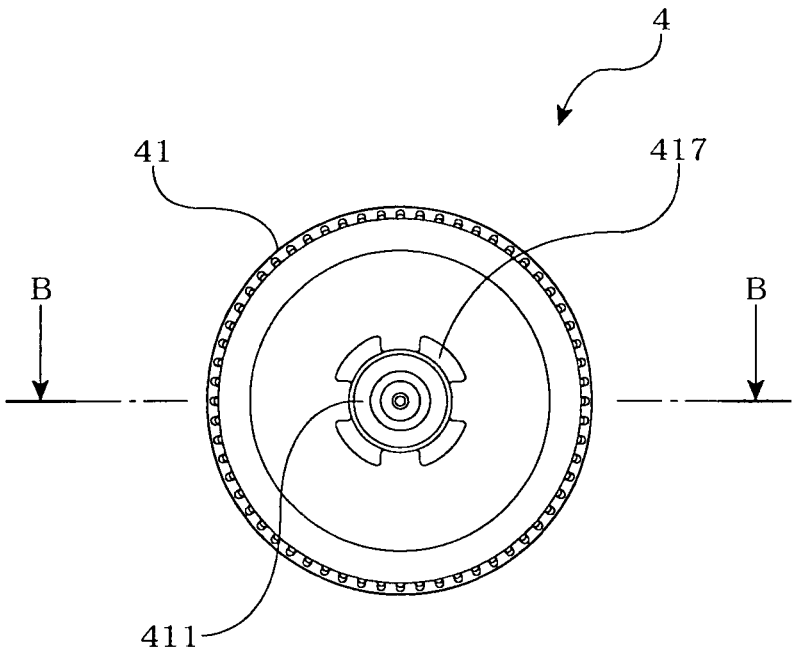
FIG. 14 is a plan view showing the opening pouring element shown in FIG. 11 as viewed from the side of the pouring port.
Figure 15:
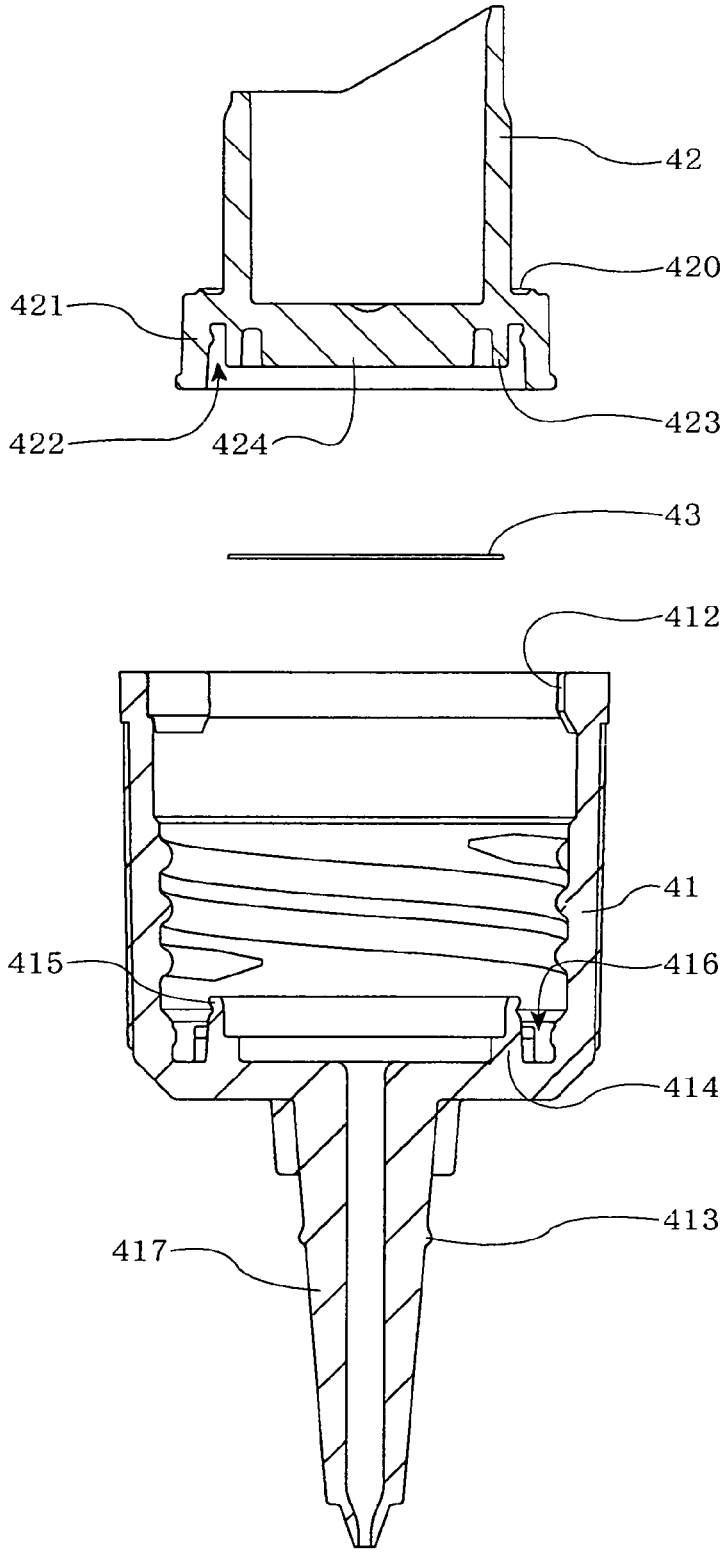
FIG. 15 is an exploded cross-sectional view of the opening pouring element shown in FIG. 11.

FIG. 14 is a plan view of the opening pouring element 4 as viewed from the front end side of the pouring port 411. FIG. 15 is an exploded cross-sectional view taken along the line B-B in FIG. 14. As shown in these figures, the opening pouring element 4 of this embodiment is formed almost in the same manner as in the first embodiment. It is different from that in the first embodiment in that the pouring port 411 is tapered, and four positioning projections 417 are formed in the base part of the pouring port 411 at an almost identical angular space. This is the result of a consideration that, when liquid droplets are dripped to a dropping container with a small diameter, if the diameter of the container is equivalent to or smaller than that of the liquid droplet, air is entrained in the liquid droplets, making correct measurement of the dripped liquid difficult. This will be explained in detail later.

The compound container 1 according to this embodiment as mentioned above can be used to the use embodiment similar to that in the first embodiment.

Figure 16:
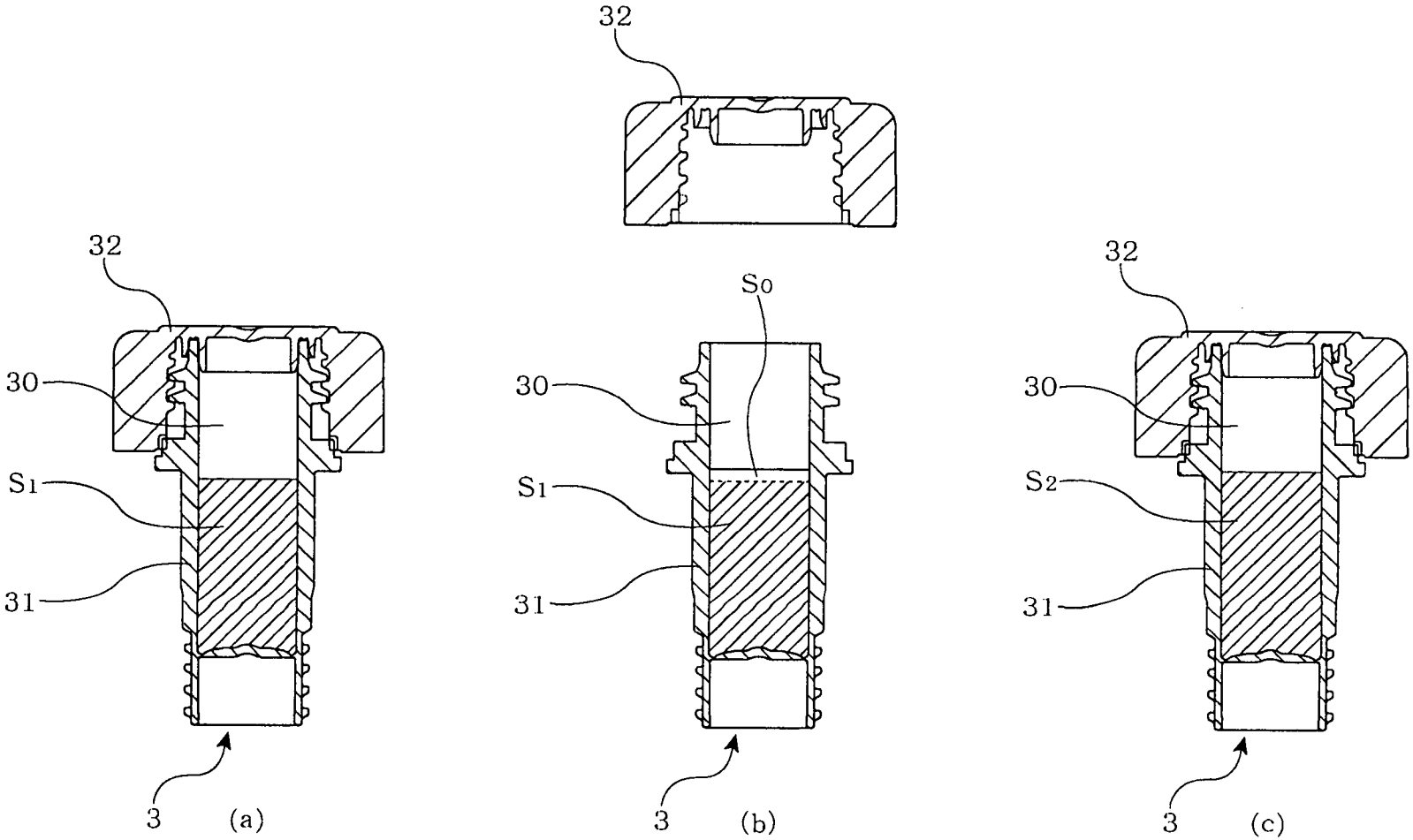
FIG. 16 is an explanatory view showing one step in the use example according to the second embodiment of the compound container of the invention.
Figure 17:
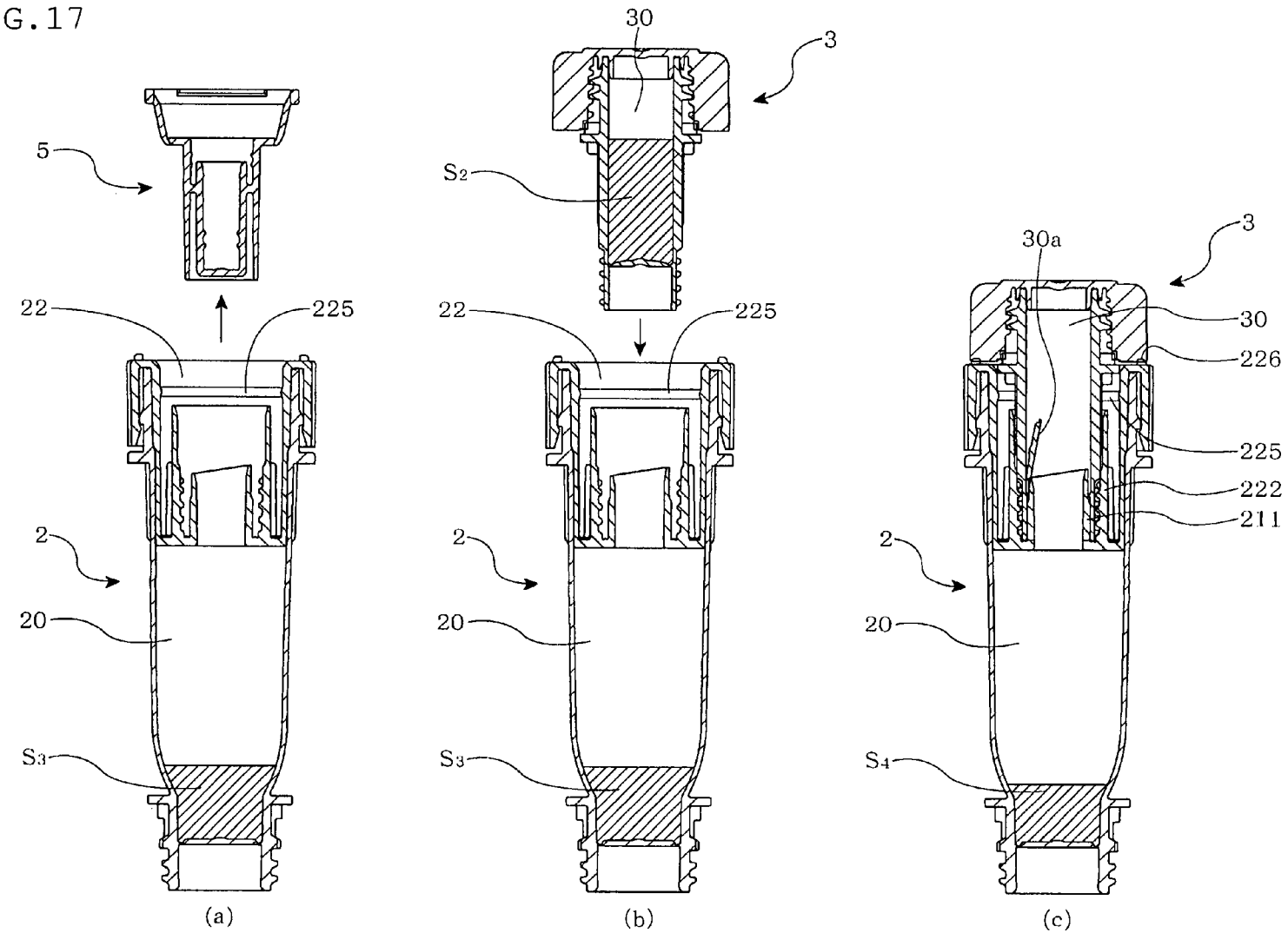
FIG. 17 is an explanatory view showing one step in the use example according to the second embodiment of the compound container of the invention.
Figure 18:
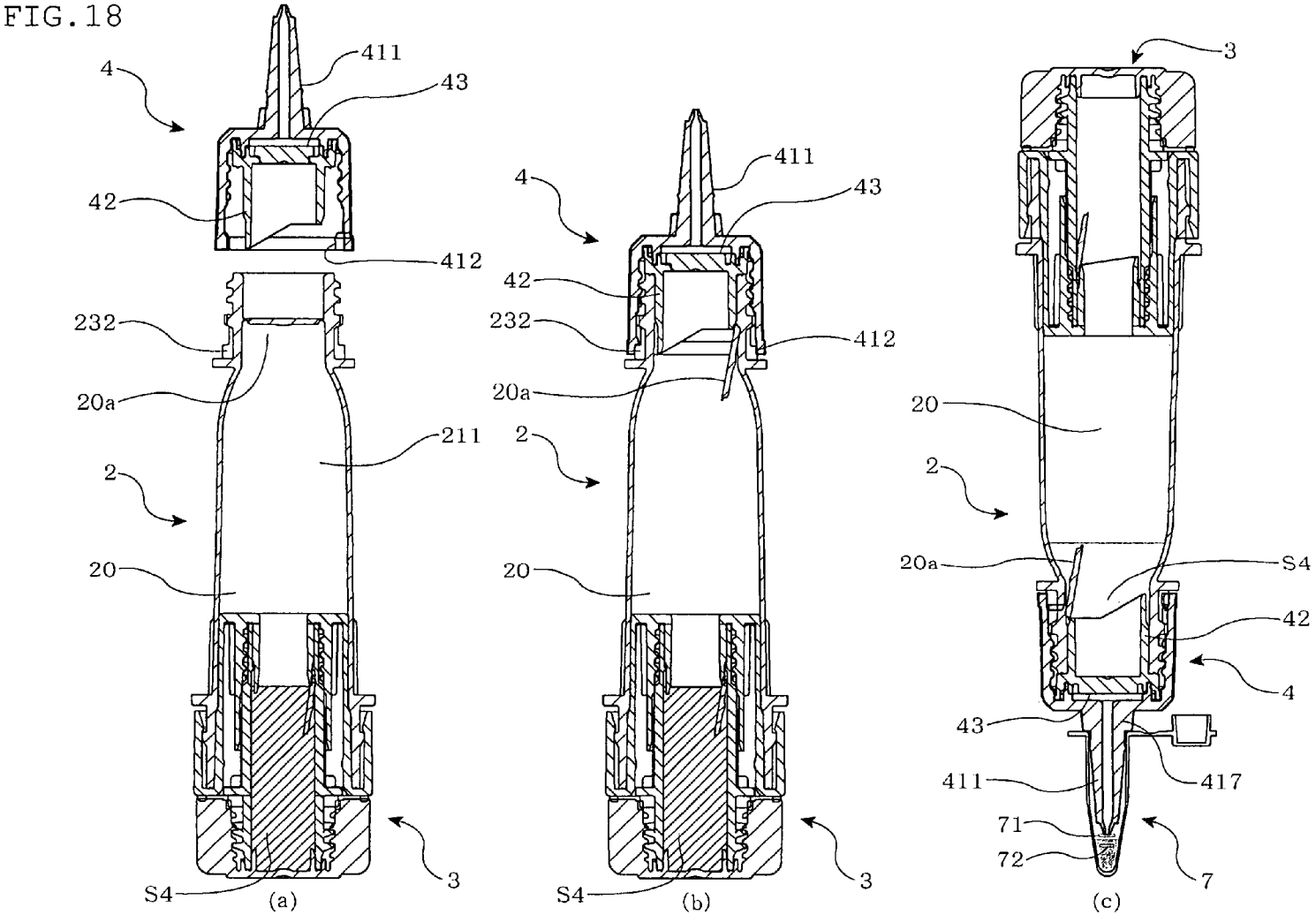
FIG. 18 is an explanatory view showing one step in the use example according to the second embodiment of the compound container of the invention.
Figure 19:
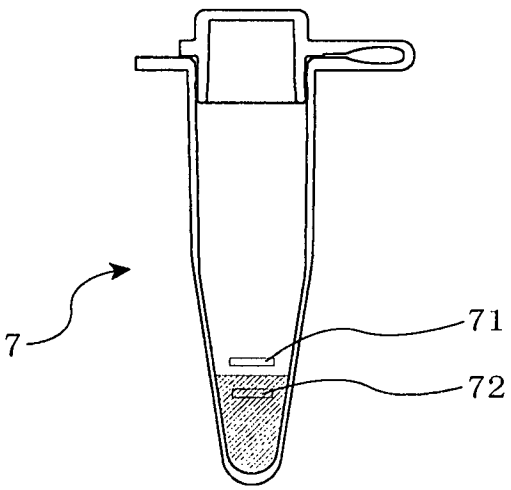
FIG. 19 is an explanatory view showing one step of sealing a filtrate which has been added dropwise to a dropping container according to the second embodiment of the compound container of the invention.
Figure 19:
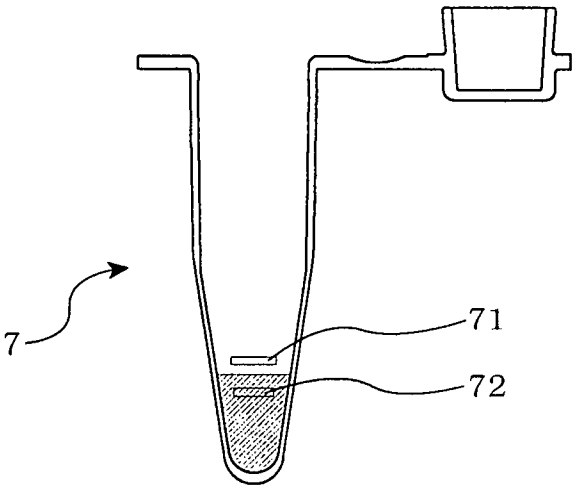
Figure 20:
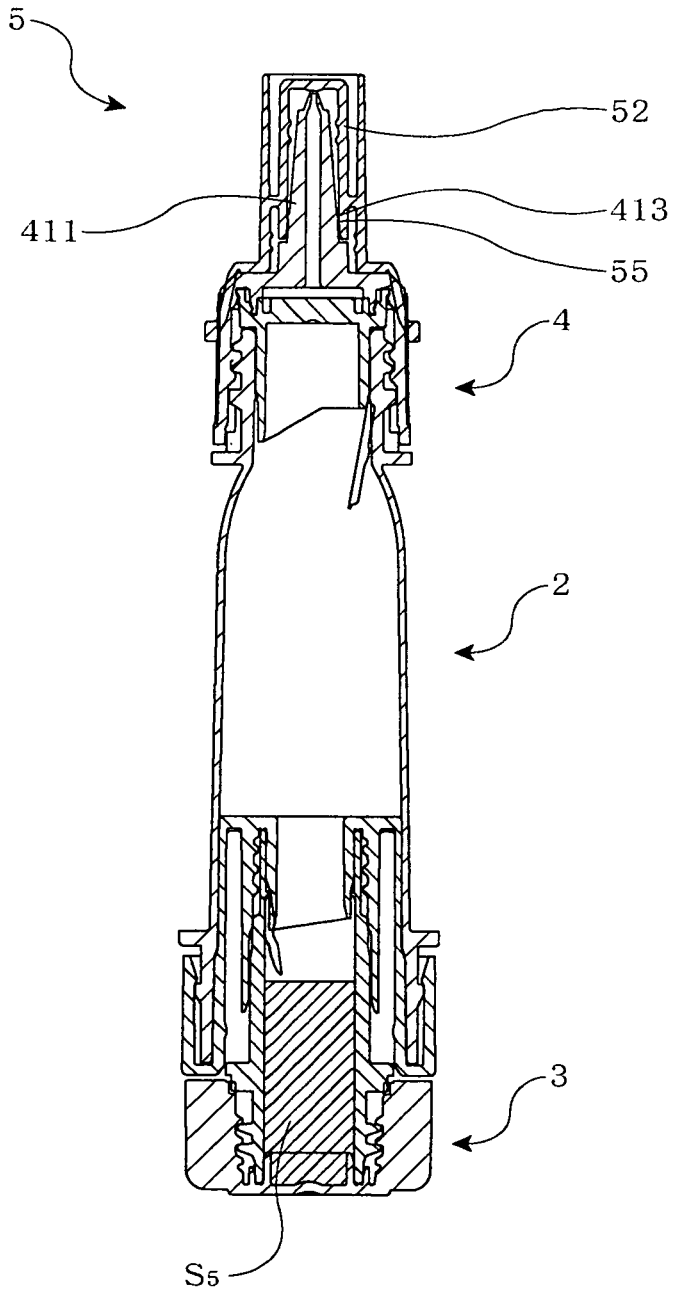
FIG. 20 is an explanatory view showing the form at the time of conducting a disposal treatment of the inspection container according to the second embodiment of the invention.

Here, FIG. 16 is an explanatory view showing the process in which the sample S0 which has been extracted from a subject is added to the reagent S1 accommodated in the auxiliary container 3, followed by a heat treatment. FIG. 17 is an explanatory view showing the process in which the auxiliary container 3 is mounted on the mounting part 22 of the container main body 2, the first accommodation chamber 20 and the second accommodation chamber 30 are intercommunicated, and the contents S2 in the heat-treated second accommodation chamber 30 is added to the adsorbent S3 accommodated within the first accommodation chamber 20, followed by stirring and mixing. FIG. 18 is an explanatory view showing the process in which the opening pouring element 4 is mounted on the contents outlet port 23, the contents S4 in the form of a slurry is filtered, and the filtrate (a sample preparation liquid) is added dropwise to the dropping container 7. FIG. 19 is an explanatory view showing the process in which the filtrate of the contents S4 which has been added dropwise to the dropping container 7. FIG. 20 is an explanatory view showing the form at the time of conducting a disposal treatment while avoiding the leakage of the contents S5 remaining in the container by attaching the sealing element 5 so as to cover the pouring port 411.

In the use embodiment of the compound container 1 according to this embodiment, the procedure by which the contents S2 obtained by adding the sample S0 to the reagent S1 is subjected to a heat treatment together with the auxiliary container 3 is the same as that of the first embodiment (see FIG. 16). In the use embodiment of the compound container 1 according to this embodiment, in mounting the auxiliary container 3 which has been subjected to a predetermined heat treatment on the mounting part 22 of the container main body 2, it differs from the first embodiment in that the auxiliary container 3 is mounted by thread engagement. As for the procedures (see FIGS. 17(*a*) to 17(*c*)) from which the contents S2 is allowed to be flown into the first accommodation chamber 20 and allows some or all of unnecessary substances to be adsorbed in the adsorbent S3, and procedures in which the opening pouring element 4 is mounted to seal the container main body 2. The procedure by which the opening pouring element 4 is mounted and the container body 2 is unsealed is the same as that of the first embodiment (see FIGS. 18(*a*) to 18(*b*)).

After the opening pouring element 4 is mounted on the container main body 2 by the above-mentioned procedure, in this embodiment, as shown in FIG. 18(*c*), while inserting the pouring port 411 of the opening pouring element 4 in the dropping container 7, the positioning of the front end of the pouring port 411 is conducted by allowing the positioning projection 417 to contact the peripheral edge of the opening of the dropping container 7. The container main body 2 is then squeezed to allow the filtrate of the contents S4 filtered by means of the filter 43 to be dripped from the pouring port 411. In this way, entrainment of air in the liquid droplets which have been dripped can be effectively avoided, whereby an appropriate amount of the filtrate can be dripped to the dropping container 7 according to the liquid level lines 71 and 72 indicated on the dropping container 7. The dropping container 7 in which an appropriate quantity of a filtrate has been dropped is capped as shown in FIG. 19(*b*) and is subjected to a subsequent reaction process.

Here, in the shown example, the two liquid level lines 71 and 72, upper and lower, are indicated on the dropping container 7, and an appropriate amount is defined as the amount when the liquid level is between these lines. That is, the liquid level line 71 is displayed at a upper position as the upper limit of an appropriate quantity, and the liquid level line 72 is indicated as a lower position as the lower limit of an appropriate quantity. By conducting positioning such that the front end of the pouring port 411 overlaps the upper liquid level line 71, when the dripped amount is too large, sucking can be conducted until the liquid level overlaps the upper liquid level line 71 by reducing the strength required for squeezing the container main body 2, thereby to recover the container main body 2.

Thus, in this embodiment, the liquid level line 72 which shows the lower limit of an appropriate amount is at least indicated on the dropping container 7, and after the front end of the pouring port 411 is positioned, the container main body 2 is squeezed to allow the filtrate to be poured after the liquid passes the liquid level line 72. When the liquid level of the filtrate becomes higher than the front end of the pouring port 411, the container main body 2 is restored while keeping the positioned state. As a result, by sucking a filtrate which has been poured in an excessive amount, an appropriate amount of a filtrate is allowed to be poured.

In this embodiment, a positioning projection 417 is provided on the base of the pouring port 411 to conduct positioning of the front end of the pouring port 411. However, the specific embodiment of the positioning means for positioning the front end of the pouring port 411 is not limited thereto. When the pouring port 411 is inserted into the dropping container 7, the distance between the front end of the pouring port 411 and the inner bottom surface of the dropping container 7 becomes constant. For example, various embodiments can be adopted, for example, an element corresponding to the positioning projection 417 may be provided on the side of the dropping container 7.

The invention is explained hereinabove with reference to preferred embodiments. However, the invention is not limited to the above-mentioned embodiments, and it is needless to say various modifications are possible within the range of the invention.

For example, in the above-mentioned embodiment, in the LAMP method, an explanation is made on the example in which the sample used for inspecting the presence of pathogenetic bacteria, such as tubercle bacillus. The use example is, however, not limited thereto. The compound container according to the invention can be used not only in the LAMP method but also in the gene amplification method such as the PCR method, other genetic detection methods, immunity measurements by the immunoassay method or a microorganism test.

In the use example shown in the above-mentioned embodiment, treating the contents S2 together with the auxiliary container 3 is mainly aimed at killing or inactivating fungus bodies, virus, etc. which are mainly contained in the sample S0 used. The treatment is not limited thereto. It may be a treatment for breaking the cell membrane of a fungus body, the envelope of a virus, etc., to take a nucleic acid out.

The compound container according to the invention can be particularly preferably used in the case where a treatment which exerts a larger influence on the sealing performance of the compound container, such as a heat treatment.

Moreover, in the invention, it is also possible to carry out the constitution in the above-mentioned two embodiments.

INDUSTRIAL APPLICABILITY

As explained above, the compound container according to the invention can be used widely as a container which enables a quick inspection, while ensuring a tester's safety and pollution control of the outside environment not only in the fields of medical treatment or medicines, but also the fields of chemistry.

The invention claimed is:

1. A compound container, comprising:

a container main body forming a first accommodation chamber, an auxiliary container forming a second accommodation chamber, a mounting part on which the auxiliary container is mounted in the container main body, a cutting part which cuts a second accommodation chamber partition wall which partitions a part of the second accommodation chamber formed in the auxiliary container, a contents outlet port on the container main body, and an opening pouring element mounted on the contents outlet port and having another cutting part which cuts a first accommodation chamber partition wall which partitions a part of the first accommodation chamber formed in the container main body, wherein when the auxiliary container is mounted on the container main body and the second accommodation chamber partition wall is cut, the first accommodation chamber and the second accommodation chamber are intercommunicated, when the opening pouring element is mounted on the container main body, the first accommodation chamber partition wall is cut so that a content is taken out from the first accommodation chamber, the container main body has a cylindrical trunk part formed of a flexible material, and the mounting part is formed with a material harder than the cylindrical trunk part separately from the cylindrical trunk part.

2. The compound container according to claim 1, wherein the contents outlet port has a whirl stopper projecting outwardly from a side of the contents outlet port and, the opening pouring element has a positioning projection at an edge of the opening pouring element, and the positioning projection contacts with the whirl stopper to prevent a rotation of the opening pouring element more than a predetermined amount.

3. A compound container, comprising:

a container main body forming a first accommodation chamber, an auxiliary container forming a second accommodation chamber, a mounting part on which the auxiliary container is mounted in the container main body, a cutting part which cuts a second accommodation chamber partition wall which partitions a part of the second accommodation chamber formed in the auxiliary container, a contents outlet port on the container main body, and an opening pouring element mounted on the contents outlet port and having another cutting part which cuts a first accommodation chamber partition wall which partitions a part of the first accommodation chamber formed in the container main body, wherein when the auxiliary container is mounted on the container main body and the second accommodation chamber partition wall is cut, the first accommodation chamber and the second accommodation chamber are intercommunicated, when the opening pouring element is mounted on the container main body, the first accommodation chamber partition wall is cut so that a content is taken out from the first accommodation chamber, a reagent treating a sample which has been collected from a subject is added to the second accommodation chamber, the sample is added to the reagent and treated together with the auxiliary container, the auxiliary container is mounted on the container main body, a content in the second accommodation chamber is flown into the first accommodation chamber, followed by stirring and mixing to allow an adsorbent adsorbing all or a part of unnecessary substances contained in the content in the second accommodation chamber in the first accommodation chamber, and the opening pouring element is attached to the container main body by cutting the first accommodation chamber partition wall to pour a sample preparation liquid which has been prepared by adsorbing all or the part of unnecessary substances with the adsorbent from a pouring port formed in the opening pouring element.

4. The compound container according to claim 3, further comprising a positioning part which positions, when the sample preparation liquid is poured from a pouring port of the opening pouring element and dripped to a predetermined dropping container, a front end of the pouring port which is inserted into the dropping container so that a distance between the front end of the pouring port and an inner bottom surface of the dropping container becomes constant.

5. A pouring method for pouring a predetermined amount of the sample preparation liquid from the compound container according to claim 4, comprising:

displaying on the dropping container a liquid level line indicating at least a lower limit of the predetermined amount, after positioning the front end of the pouring port while inserting the pouring port into the dropping container, squeezing the container main body to pour the sample preparation liquid until an amount of the sample preparation liquid which has been poured exceeds the liquid level line showing the lower limit, and when a liquid level of the sample preparation liquid which has been poured exceeds the front end of the positioned pouring port, while keeping a positioned state, restoring the container main body to suck the sample preparation liquid which has been excessively poured, thereby pouring an adequate amount of the sample preparation liquid.

6. A compound container, comprising:

a container main body forming a first accommodation chamber, an auxiliary container forming a second accommodation chamber, a mounting part on which the auxiliary container is mounted in the container main body, a cutting part which cuts a second accommodation chamber partition wall which partitions a part of the second accommodation chamber formed in the auxiliary container, a contents outlet port on the container main body, and an opening pouring element mounted on the contents outlet port and having another cutting part which cuts a first accommodation chamber partition wall which partitions a part of the first accommodation chamber formed in the container main body, wherein when the auxiliary container is mounted on the container main body and the second accommodation chamber partition wall is cut, the first accommodation chamber and the second accommodation chamber are intercommunicated, when the opening pouring element is mounted on the container main body, the first accommodation chamber partition wall is cut so that a content is taken out from the first accommodation chamber, the another cutting part is formed in a cylindrical shape and has a narrow tip narrowing an outer diameter of an end of the another cutting part, and the first accommodation chamber partition wall cut by the another cutting part is sandwiched and held in a space formed between the narrow tip and an inner peripheral surface of the contents outlet port while a part of the first accommodation chamber partition wall is connected to the inner peripheral surface of the contents outlet port.

7. The compound container according to claim 6, further comprising a pouring port formed on the opening pouring element, a narrowing part which narrows an area of an opening of the pouring port formed on a front end side of the pouring port formed on the opening pouring element, and a truncated cone-shaped concave part formed on a front end of the pouring port.

8. The compound container according to claim 6, wherein the opening pouring element is provided with an outer cylindrical part on which the pouring port is formed, the another cutting part which is installed on an inside of the outer cylindrical part, and a filter which is retained between the outer cylindrical part and the another cutting part.

9. The compound container according to claim 6, further comprising a sealing element which is detachably attached to the mounting part provided in the container main body to seal the first accommodation chamber, wherein the scaling element is removed from the mounting part when the auxiliary container is attached to the container main body, and when the container is disposed, the sealing element is attached to the pouring port of the opening pouring element to seal the container, and prevents a leakage of contents remaining in the container.

10. The compound container according to claim 6, further comprising a protection element which is detachably attached to the contents outlet port provided in the container main body.

11. The compound container according to claim 6, wherein the auxiliary container further comprises a trunk part of which one end side serves as an opening part and the other end side is blocked by the second accommodation chamber partition wall and a lid which is installed on the opening part and serves to seal the second accommodation chamber, and the lid has a part which is in close contact with an inner peripheral surface of the trunk part.

12. The compound container according to claim 11, further comprising a circular projection which contacts with a front end surface of a peripheral edge of the opening part of the trunk part of the auxiliary container at a corresponding position on a side of the lid.

13. The compound container according to claim 11, further comprising a sealing cylinder formed on an outer peripheral side of the cutting part formed on the mounting part, wherein the cutting part is formed in a cylindrical shape, the sealing cylinder and the cutting part are rising concentrically from each other, and when the auxiliary container is mounted on the mounting part for cutting the second accommodation chamber partition wall, the cutting part is in close contact with the inner peripheral surface of the trunk part, and the sealing cylinder is in close contact with an outer peripheral surface of the trunk part of the auxiliary container.

14. The compound container according to claim 6, wherein the auxiliary container has a trunk part, the cutting part is formed in a cylindrical shape in the mounting part and has another narrow tip narrowing an outer diameter of an end of the cutting part, and the second accommodation chamber partition wall cut by the cutting part is sandwiched and held in a space formed between the another narrow tip and an inner peripheral surface of the trunk part while a part of the second accommodation chamber partition wall is connected to the inner peripheral surface of the trunk part.

15. The compound container according to claim 6, further comprising a cyclic projection contacting with a front end surface of the contents outlet port formed at a position corresponding to the opening pouring element.

16. The compound container according to claim 15, wherein the cyclic projection is formed concentrically with the another cutting part.

17. The compound container according to claim 8, wherein the outer cylindrical part has a supporting part supporting a peripheral edge of the filter, an engagement projection projecting along an outer peripheral edge of the supporting part, and an engagement groove circularly formed on an outer peripheral side of the supporting part, the another cutting part has a cyclic engagement part formed on a base side of the another cutting part, and an engagement groove part formed on the base side of the another cutting part, and the engagement projection engages with the engagement groove part, and the engagement groove engages with the cyclic engagement part when the another cutting part is attached to the outer cylindrical part.

18. The compound container according to claim 6, wherein a tip of the another cutting part has an obliquely-cut edge, the tip of the another cutting part cuts a part of the first accommodation chamber partition wall when the container main body is mounted on the opening pouring element, and the obliquely-cut edge of the another cutting part further cuts a periphery of the first accommodation chamber partition wall gradually as the container main body is pushed in to the opening pouring element.

19. The compound container according to claim 18, wherein the container main body has a whirl stopper at an outer circumferential part of the first accommodation chamber partition wall, the opening pouring element has a positioning projection at an outer circumferential part of the another cutting part, and the positioning projection contacts with the whirl stopper to stop rotation of the opening pouring element and leave the part of the first accommodation chamber partition wall connected to the inner peripheral surface of the contents outlet port.

* * * * *